US007845758B2

(12) United States Patent
Hayashi et al.

(10) Patent No.: US 7,845,758 B2
(45) Date of Patent: Dec. 7, 2010

(54) SUCTION DEVICE, SUCTION SYSTEM, AND LIQUID DROPLET EJECTION APPARATUS HAVING THE DEVICE OR THE SYSTEM, AS WELL AS ELECTRO-OPTICAL APPARATUS AND MANUFACTURING METHOD THEREOF

(75) Inventors: Chiyoshi Hayashi, Okaya (JP); Chieko Iuchi, Suwa (JP)

(73) Assignee: Seiko Epson Corporation (JP)

( * ) Notice: Subject to any disclaimer, the term of this patent is extended or adjusted under 35 U.S.C. 154(b) by 205 days.

(21) Appl. No.: 12/197,502

(22) Filed: Aug. 25, 2008

(65) Prior Publication Data

US 2009/0058925 A1 Mar. 5, 2009

(30) Foreign Application Priority Data

Aug. 27, 2007 (JP) ..... 2007-220353

(51) Int. Cl.
*B41J 2/165* (2006.01)

(52) U.S. Cl. ..... 347/29; 347/30; 347/23

(58) Field of Classification Search ..... 347/23, 347/24, 29, 30, 32, 36
See application file for complete search history.

(56) References Cited

U.S. PATENT DOCUMENTS

| | | | | |
|---|---|---|---|---|
| 5,625,385 | A * | 4/1997 | Suzuki | 347/24 |
| 6,364,449 | B1 * | 4/2002 | Takahashi et al. | 347/30 |
| 6,494,560 | B1 * | 12/2002 | Seshimo et al. | 347/23 |
| 7,334,862 | B2 * | 2/2008 | Kachi | 347/22 |
| 7,556,340 | B2 * | 7/2009 | Umeda et al. | 347/29 |

FOREIGN PATENT DOCUMENTS

| | | |
|---|---|---|
| JP | 2005-254798 | 9/2005 |
| JP | 2006-272679 | 10/2006 |

* cited by examiner

*Primary Examiner*—Shih-Wen Hsieh
(74) *Attorney, Agent, or Firm*—Harness, Dickey & Pierce, P.L.C.

(57) ABSTRACT

Provided herein is a suction device having a plurality of head caps capable of closely contacting with and moving away from corresponding nozzle surfaces of a plurality of inkjet functional liquid droplet ejection heads. The suction device includes: a plurality of cap units having one or more of the head caps, a contacting/separating mechanism which makes the head caps contact and move away, a plurality of suction units which suck functional liquid from the head caps, a plurality of sets of suction channels each of which having a main channel and individual channels, and a plurality of channel switching units which selectively switch the suction channels to any one of the suction units.

14 Claims, 27 Drawing Sheets

SUCTION DEVICE, SUCTION SYSTEM, AND LIQUID DROPLET EJECTION APPARATUS HAVING THE DEVICE OR THE SYSTEM, AS WELL AS ELECTRO-OPTICAL APPARATUS AND MANUFACTURING METHOD THEREOF

The entire disclosure of Japanese Patent Application No. 2007-220353, filed Aug. 27, 2007, is expressly incorporated by reference herein.

BACKGROUND

1. Technical Field

The present invention relates to a suction device and a suction system which have a plurality of head caps capable of closely contacting with and moving away from corresponding nozzle surfaces of a plurality of inkjet functional liquid droplet ejection heads, and a liquid droplet ejection apparatus having the device or the system, as well as an electro-optical apparatus and a manufacturing method thereof.

2. Related Art

It is known that suction systems have seven suction units (suction devices) on which twelve head caps are mounted, corresponding to seven carriage units on which twelve functional liquid droplet ejection heads are mounted (JP-A-2005-254798).

Each suction device (suction unit) includes a cap unit on which twelve head caps are mounted on a cap plate, a contacting/separating mechanism that contacts and moves the twelve head caps with and away from twelve functional liquid droplet ejection heads by using the cap plate, a waste liquid tank communicating to the twelve head caps, an ejector that connects its secondary side to the waste liquid tank in order to apply suction pressure to the tank, and a suction channel that connects the twelve head caps to the waste liquid tank.

When compressed air is introduced to a primary side of the ejector to drive the ejector while the head caps are closely contacted with their corresponding functional liquid droplet ejection heads, inside the waste tank and the suction channel is under negative pressure so that the functional liquid is sucked from the twelve functional liquid droplet ejection heads via the twelve head caps. The head caps are slightly spaced apart from the functional liquid droplet ejection heads, and thereafter the ejector is driven while the functional liquid droplet ejection heads are subjected to ejection for maintenance (flushing), whereby ejection for maintenance can be undergone. As such, the above two functions allow the function of the twelve functional liquid droplet ejection heads to be maintained and recovered.

Each of the seven suction devices (suction units) is independently provided in such related-art suction systems, and the waste liquid tank and the ejector are independently provided. This arrangement disadvantageously decreases space efficiency and makes the structure complex. In this case, such a disadvantage can be overcome if the seven suction devices, the waste liquid tank, and the ejector are integrated into a unit.

However, suction pressure for sucking functional liquid from a number of ejection nozzles is higher than suction pressure for sucking functional liquid ejected from the head caps. Thus, if an operation method is taken in which a suction device performing suction and a suction device undergoing ejection for maintenance are provided together, it is impossible to conduct both operations with the above configuration.

SUMMARY

An advantage of some aspects of the invention is to provide a suction device and a suction system which concurrently perform a suction process with different levels of suction pressure in units of cap units, improve space efficiency, and make their structure simple, and also to provide a liquid droplet ejection apparatus having such a device or a system, as well as an electro-optical apparatus and manufacturing method thereof.

According to one aspect of the invention, a suction device includes a plurality of head caps capable of closely contacting with and moving away from corresponding nozzle surfaces of a plurality of inkjet functional liquid droplet ejection heads, and also including a plurality of cap units on which one or more of the head caps are mounted, a contacting/separating mechanism that makes the respective head caps contact with and move away from in units of the cap units, a plurality of suction units each of which is connected to the cap units and sucks functional liquid from the head caps in units of the cap units with different levels of suction pressure from each other, a plurality of sets of suction channels each of which includes a main channel connecting an upstream side thereof to the associated cap units and a plurality of individual channels branched from the main channel through a branch and connecting downstream sides thereof to the associated suction units, and a plurality of channel switching units that is disposed at the respective branches of the suction channels and selectively switches the suction channels to any one of the suction units.

With this configuration, the channel switching units allow the cap units to communicate with the suction units with different levels of suction pressure from each other in units of the cap units by selectively switching the suction channels to any one of the suction units. Specifically, in the suction process, high or low suction pressure can be selectively applied to the functional liquid droplet ejection heads via the head caps in units of the cap units. This allows the suction process to be conducted by concurrently applying different levels of suction pressure to the cap units. Further, since the suction process is applied to the plurality of cap units in each of the suction units, the number of the suction units can be decreased as compared with the case of providing suction units in units of the cap units, whereby improvement of space efficiency and simple structure can be achieved.

It is preferable that each of the suction units also include a waste liquid tank connected to a downstream end of the individual channels, and an ejector having a primary side with compressed air introduced thereto and a secondary side connected to an upper space of the waste liquid tank.

With this configuration, the structure of the suction units can be simplified while having excellent chemical resistance to functional liquid.

It is preferable that each of the suction units have a pressure adjustment unit that adjusts pressure of the compressed air at the primary side, and a control unit that controls the pressure adjustment unit.

With this configuration, negative pressure (suction pressure) for suction to be introduced to each waste liquid tank can be easily adjusted in consideration of the viscosity of functional liquid or suction manners. Such adjustment can be easily made even in a case where different types of functional liquid are newly introduced or a case where a suction manner is altered. It is preferable that a regulator (electro-pneumatic regulator) be used as a pressure adjustment unit.

It is preferable that each of the individual channels connected to the respective suction units be provided with a channel opening/closing unit that opens and closes the individual channels, and each of the control units controls the pressure adjustment unit depending on the number of opening of the channel opening/closing unit that is open out of the channel opening/closing units such that a suction pressure is constant in the cap units.

With this configuration, the channel opening/closing unit allows the channel connection between the cap units and the suction units to be opened and closed by opening and closing the individual channels, whereby the suction process can be conducted by opening and closing the channel opening/closing units when some functional liquid droplet ejection heads are subjected to the suction process and others are not. Moreover, the suction pressure can be constant in each of the cap units (head caps) by controlling the pressure adjustment unit depending on the number of opening of the channel opening/closing unit that is open. This makes the suction flow rates of the cap units (head caps) constant independent of the number of functional liquid droplet ejection heads which conduct the suction process.

It is preferable that the suction device further have a pressure detection unit that detects pressure in each of the waste liquid tanks during suction, and each of the control units control the pressure adjustment unit such that the pressure in the waste liquid tank is set to be a predetermined pressure according to the number of opening of the channel opening/closing unit.

It is also preferable that the suction device further have a flow rate detection unit that detects a flow rate of functional liquid flowing into each of the waste liquid tanks by suction, wherein the control unit controls the pressure adjustment unit such that the flow rate of the functional liquid flowing into the waste liquid tank is set to be a predetermined flow rate according to the number of opening of the channel opening/closing unit.

With this configuration, the suction pressure can be controlled to be constant in any of cap units (head caps), whereby the suction process can be appropriately applied to the functional liquid droplet ejection heads in consideration of types of functional liquid.

It is preferable that a plurality of suction units be composed of two kinds of suction units, one of the suction units sucking functional liquid with the head caps closely contacted with the functional liquid droplet ejection heads and the other of the suction units sucking functional liquid with the head caps spaced away from the functional liquid droplet ejection heads.

With this configuration, one suction unit can be a unit for functional recovery which sucks the functional liquid from the functional liquid droplet ejection heads while the other suction unit can be a unit for functional maintenance which sucks the functional liquid ejected for maintenance from the functional liquid droplet ejection heads from the head caps, for example. This allows the suction units to be appropriately selected according to a state such as clogging at the functional liquid droplet ejection heads.

It is preferable that the individual channels are combined by a manifold and connected to the suction units via junction channels, and the manifold is formed like a funnel of which upper end is blocked by a discoidal cover and downstream ends of the individual channels are so connected to the cover as to be evenly arranged in a circumferential direction of the manifold.

With this configuration, a plurality of individual channels are so connected to the cover of the manifold formed like a funnel as to be evenly arranged in the circumferential direction, so that pressure loss of the individual channels can be equalized in the channels from the individual channels through the junction channels. In other words, if the channel length and diameter of the individual channels are set to be even, the suction pressure in the cap units can be constant in each suction unit.

According to another aspect of the present invention, a suction system includes a plurality of functional liquid droplet ejection heads arranged in a plurality of sets of colors of functional liquid and a plurality of sets of the above-described suction devices by the colors of the functional liquid.

It is preferable that the plurality of sets of suction devices be composed of six sets of suction devices corresponding to six colors of the functional liquid.

It is preferable that a plurality of sets of one or more of the head caps by color be mounted on a carriage unit.

With this configuration, the suction process can be conducted by concurrently applying different levels of suction pressure to the functional liquid droplet ejection heads by color via the plurality of cap units, whereby the function of the functional liquid droplet ejection heads for each color can be appropriately maintained and recovered.

According to a further aspect of the invention, a liquid droplet ejection apparatus includes a plotting unit that performs plotting on a workpiece by ejecting functional liquid droplets from a plurality of inkjet functional liquid droplet ejection heads while moving the functional liquid droplet ejection heads, and the above-described suction device.

With this configuration, the function of the functional liquid droplet ejection heads for each color can be appropriately maintained and recovered, thereby improving productivity in processing workpieces.

According to a still further aspect of the invention, a liquid droplet ejection apparatus includes a plotting unit that performs plotting on a workpiece by ejecting functional liquid droplets from a plurality of inkjet functional liquid droplet ejection heads while moving the functional liquid droplet ejection heads, and the above-described suction system.

With this configuration, functional liquid of a plurality of colors is used to perform plotting on workpieces while the function of the functional liquid droplet ejection heads for each color can be appropriately maintained and recovered, thereby improving productivity in processing workpieces.

According to yet another aspect of the present invention, a manufacturing method of an electro-optical apparatus includes forming a film portion on a workpiece with functional liquid droplets by using the above-described liquid droplet ejection apparatus.

According to a still further aspect of the invention, an electro-optical apparatus includes a film portion formed on a workpiece with functional liquid droplets by using the above-described liquid droplet ejection apparatus.

With this configuration, high quality electro-optical apparatuses can be efficiently manufactured. Examples of functional materials include: filter materials (filter elements) of color filters for liquid crystal displays, fluorescent materials (phosphor) for field emission displays (FED), fluorescent materials (phosphor) for plasma display panels (PDP), and electrophoretic materials (electrophoretic substances) for electrophoresis displays, in addition to light emitting materials for organic electroluminescence devices (electroluminescence layer, hole injection layer). These materials are liquid materials that can be ejected from the functional liquid droplet ejection heads (inkjet heads). Examples of the electro-optical apparatus (flat panel display, FPD) include organic electroluminescence devices, liquid crystal displays, electron emission devices, PDPs, and electrophoresis displays.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the present invention will now be described below with reference to the accompanying drawings in which the functional liquid supply device according to the present invention is applied to a liquid droplet ejection apparatus. The liquid droplet ejection apparatus is installed in a manufacturing line for flat panel displays where, for example, functional liquid droplet ejection heads to which functional liquid such as special inks and luminescent resin liquids is introduced are used to form color filters for liquid crystal displays or light emitting elements constituting pixels of organic electroluminescence devices.

Figure 1:
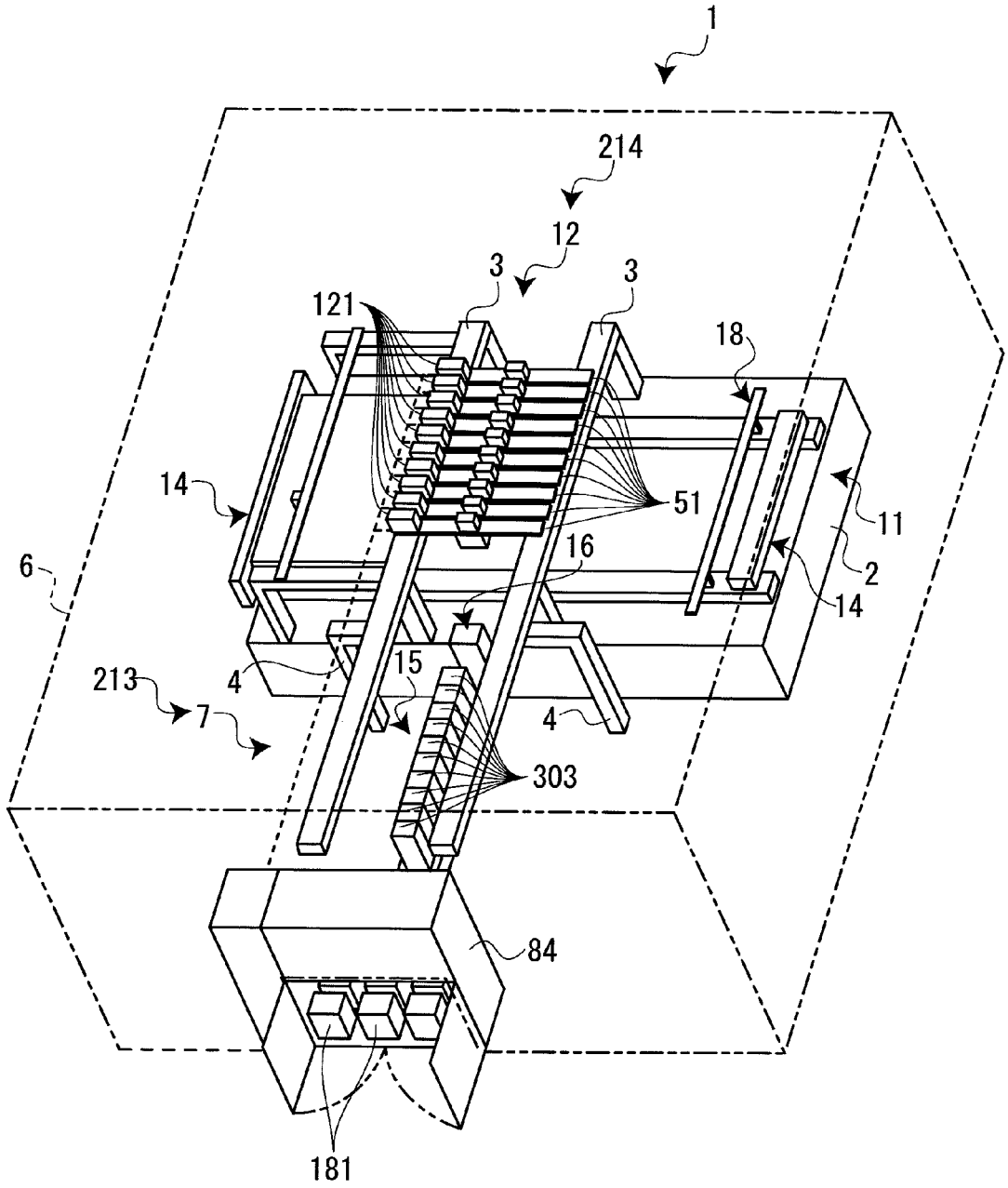
FIG. 1 is a perspective view of a liquid droplet ejection apparatus according to an embodiment.
Figure 2:
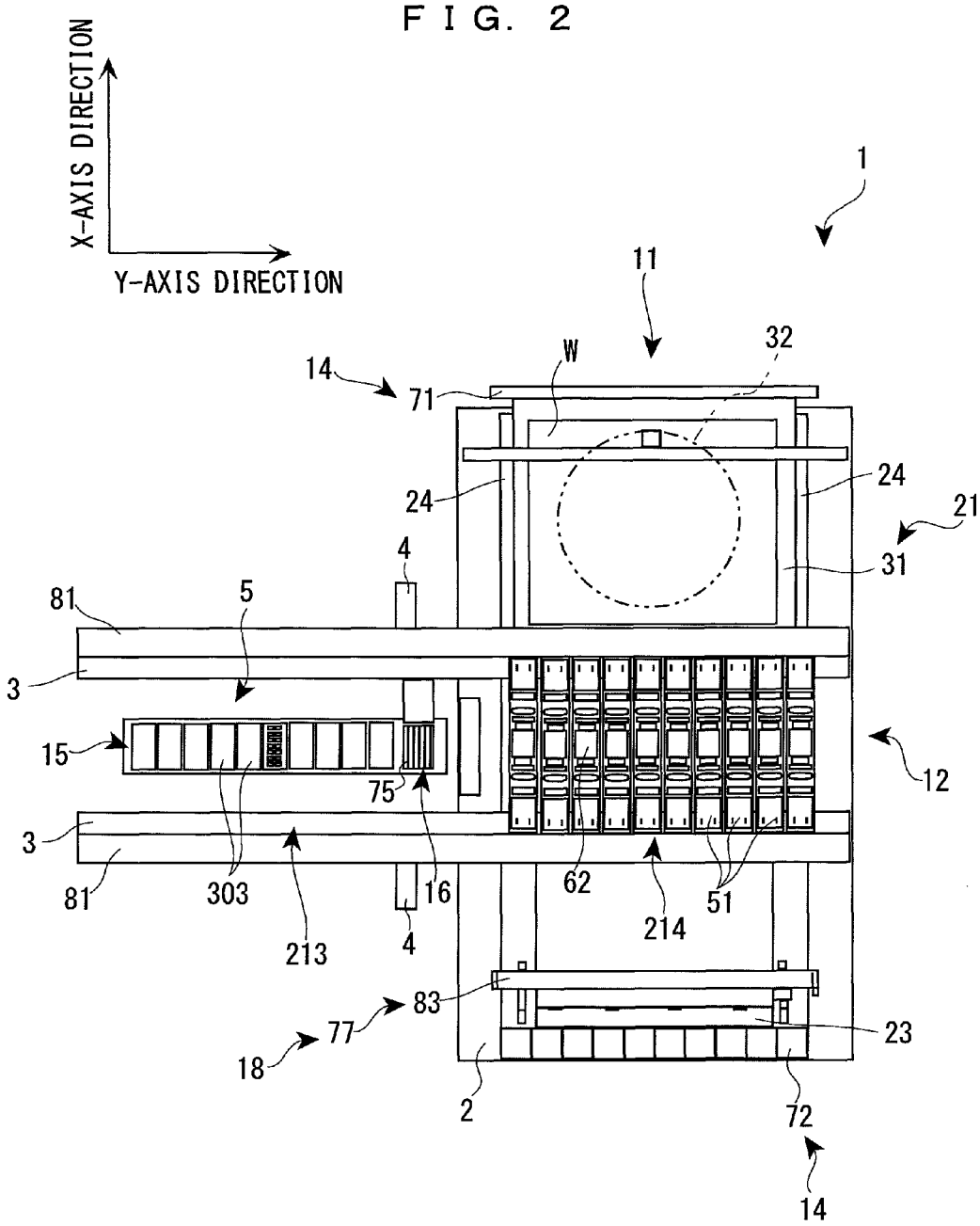
FIG. 2 is a plan view of the liquid droplet ejection apparatus.
Figure 3:
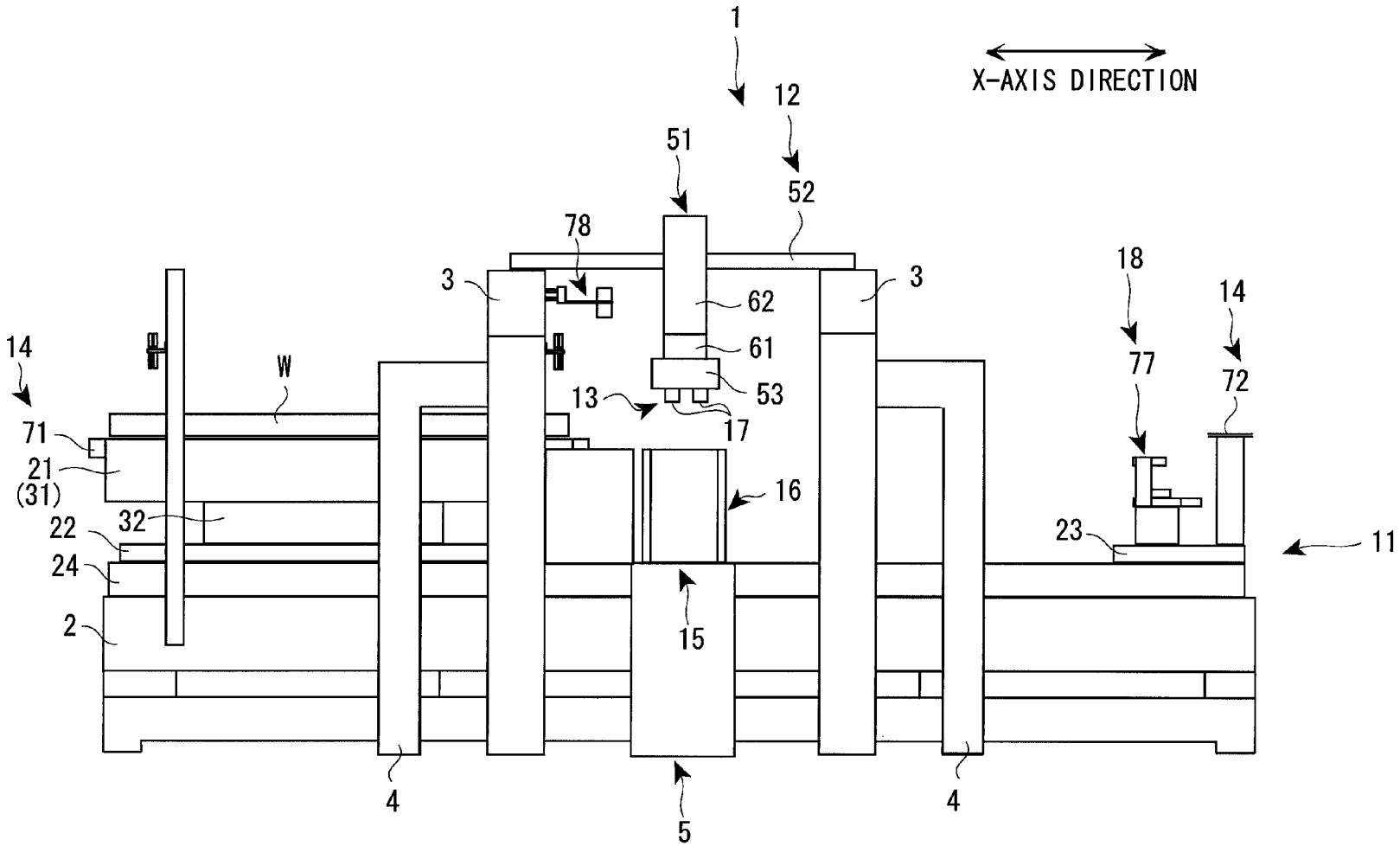
FIG. 3 is a side view of the liquid droplet ejection apparatus.

Referring to FIGS. 1, 2, and 3, a liquid droplet ejection apparatus 1 includes an X-axis table 11, a Y-axis table (moving table) 12, and ten carriage units 51. The X-axis table 11 is disposed on an X-axis support base 2 supported on a stone surface plate, extends in the X-axis direction that is a main scanning direction, and moves a workpiece W in the X-axis direction (main scanning direction). The Y-axis table 12 is disposed on a pair of (two) Y-axis support bases 3 arranged to stride across the X-axis table 11 using a plurality of poles 4 and extends in the Y-axis direction that is a sub-scanning direction. The ten carriage units 51 include functional liquid droplet ejection heads 17 mounted thereon. The carriage units 51 are movably suspended over the Y-axis table 12. Further, the liquid droplet ejection apparatus 1 includes a chamber 6 which accommodates the above components in an atmosphere with humidity and temperature controlled and a functional liquid supplying unit 7 that supplies functional liquid to the functional liquid droplet ejection heads 17 inside the chamber 6 through the chamber 6 from the outside of the chamber 6. The functional liquid droplet ejection heads 17 are driven, in synchronization with driving of the X-axis table 11 and the Y-axis table 12, to eject functional liquid droplets of six colors, so that a predetermined plotting pattern is drawn on a workpiece W. The plotting unit as defined in the claims is composed of the X-axis table 11, Y-axis table 12, and ten carriage units 51.

Further, the liquid droplet ejection apparatus 1 includes a maintenance device 5 composed of a flushing unit 14, a suction unit (suction system) 15, a wiping unit 16, and an ejection performance test unit 18. These units are used for maintenance of the functional liquid droplet ejection heads 17 so that the functions of the functional liquid droplet ejection heads 17 can be maintained and recovered. Among the units composing the maintenance device 5, the flushing unit 14 and ejection performance test unit 18 are mounted on the X-axis table 11, the suction unit 15 and wiping unit 16 extend orthogonally to the X-axis table 11 and are disposed on a platform placed where the carriage units 51 can be moved by using the Y-axis table 12 (Specifically, the ejection performance test unit 18 has a stage unit 77 mounted on the X-axis table 11 and a camera unit 78 supported on one of the Y-axis support bases 3, as will be described later).

The flushing unit 14 includes a pair of pre-plotting flushing units 71 and a periodic flushing unit 72 both of which are subjected to ejection for maintenance (flushing) from the functional liquid droplet ejection heads 17 immediately before ejection from the functional liquid droplet ejection heads 17 or in a pause in plotting to replace the workpiece W with a new one. The suction unit 15 has ten cap units 303 that forcedly suck the functional liquid from ejection nozzles 98 of the functional liquid droplet ejection heads 17 and cap the nozzles. The wiping unit 16 has a wiping sheet 75 that wipes excess functional liquid off nozzle surfaces 97 of the functional liquid droplet ejection heads 17 after the suction. The ejection performance test unit 18 has the stage unit 77 and the camera unit 78, and, inspects the ejection performance of the functional liquid droplet ejection heads 17 (whether ejection is performed and whether functional liquid droplets are ejected straight). Mounted on the stage unit 77 is a test sheet 83 to receive functional liquid droplets ejected from the functional liquid droplet ejection heads 17. The camera unit 78 is used to inspect the functional liquid droplets on the stage unit 77 by image recognition.

Components of the liquid droplet ejection apparatus 1 will now be described. As shown in FIGS. 2 and 3, the X-axis table 11 includes a set table 21, a first X-axis slider 22, a second X-axis slider 23, a pair of right and left X-axis linear motors (not shown), and a pair of (two) X-axis common supporting bases 24. The set table 21 is used to set a workpiece W in place. The first X-axis slider 22 slidably supports the set table 21 in the X-axis direction. The second X-axis slider 23 slidably supports the flushing unit 14 and the stage unit 77 in the X-axis direction. The right and left X-axis linear motors extend in the X-axis direction and move the set table 21 (workpiece W) in the X-axis direction through the first X-axis slider 22, while moving the flushing unit 14 and stage unit 77 in the X-axis direction through the second X-axis slider 23. The X-axis common supporting bases 24 are arranged side by side to the X-axis linear motors and guides the first X-axis slider 22 and the second X-axis slider 23.

The set table 21 has, for example, a suction table 31 that is used for sucks and sets the workpiece W in place and a θ table 32 that supports the suction table 31 to correct the position of the workpiece W set on the suction table 31 in a θ direction. The pre-plotting flushing units 71 are additionally provided to a pair of sides of the set table 21 parallel to the Y-axis direction.

The Y-axis table 12 includes ten bridge plates 52 having ten carriage units 51 suspended thereover, ten pairs of Y-axis sliders (not shown) that support the ten bridge plates 52 at their both sides, and a pair of Y-axis linear motors (not shown) that is disposed on the pair of Y-axis support bases 3 and moves the bridge plates 52 in the Y-axis direction through the ten pairs of Y-axis sliders. The Y-axis table 12 sub-scans the functional liquid droplet ejection heads 17 through the carriage units 51 during plotting, and controls the functional liquid droplet ejection heads 17 to face the maintenance device 5 (suction unit 15 and wiping unit 16).

The pair of Y-axis linear motors is (synchronously) driven to translate the Y-axis sliders synchronously in the Y-axis direction by using the pair of Y-axis support bases 3 as guides, whereby the bridge plates 52 move in the Y-axis direction along with the carriage units 51. In this case, each of the carriage units 51 may independently move by drive-controlling the Y-axis linear motors, or the ten carriage units 51 may integrally move.

Cable supporting members 81 are disposed on both sides of the Y-axis table 12 to be parallel to the Y-axis table 12. Each of the cable supporting members 81 has one end secured to the Y-axis support base 3 and the other end secured to one of the bridge plates 52. The cable supporting members 81 accommodate, for example, cables, air tubes, and functional liquid channels for the carriage units 51.

Figure 4:
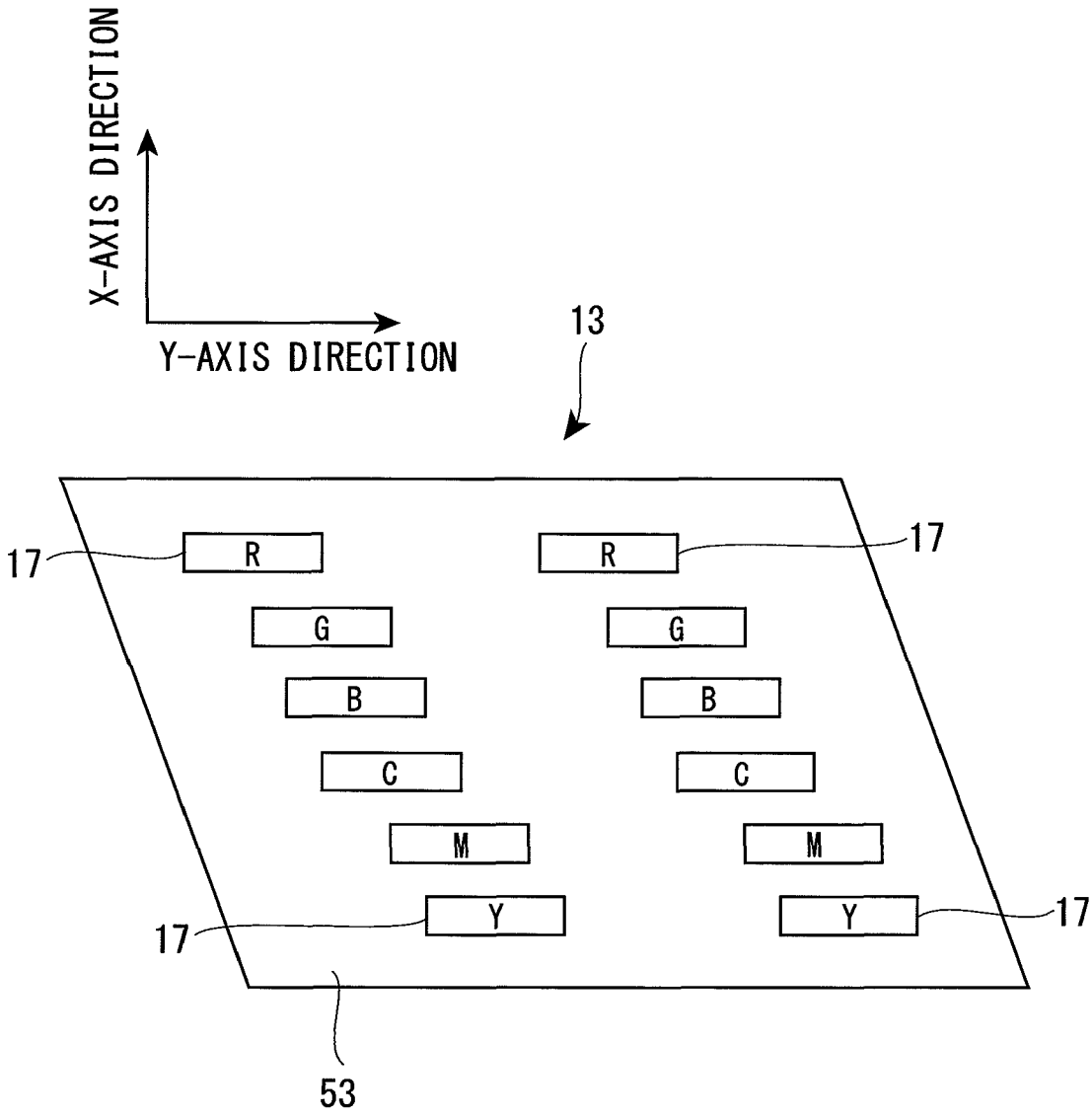
FIG. 4 is a view showing functional liquid droplet ejection heads constituting head groups.

Each of the carriage units 51 includes a head unit 13 having six pairs of functional liquid droplet ejection heads 17 each pair of which corresponds to a single color (R, G, B, C, M, and Y), and a head plate 53 that supports the twelve functional liquid droplet ejection heads 17 divided into two groups each of which has six liquid droplet ejection heads (see FIG. 4). Further, the carriage units 51 includes a θ rotation mechanism 61 that supports the head unit 13 so that the head unit 13 can be subjected to θ correction (θ rotation), and a hanging member 62 that supports the head unit 13 on the Y-axis table 12 (bridge plates 52) by using the θ rotation mechanism 61. In addition, each of the carriage units 51 has a sub-tank 121 on its upper part (specifically, on the bridge plates 52) to supply the functional liquid droplet ejection heads 17 with functional liquid using natural water heads from the sub-tank 121 and through pressure reducing valves (not shown).

Figure 5:
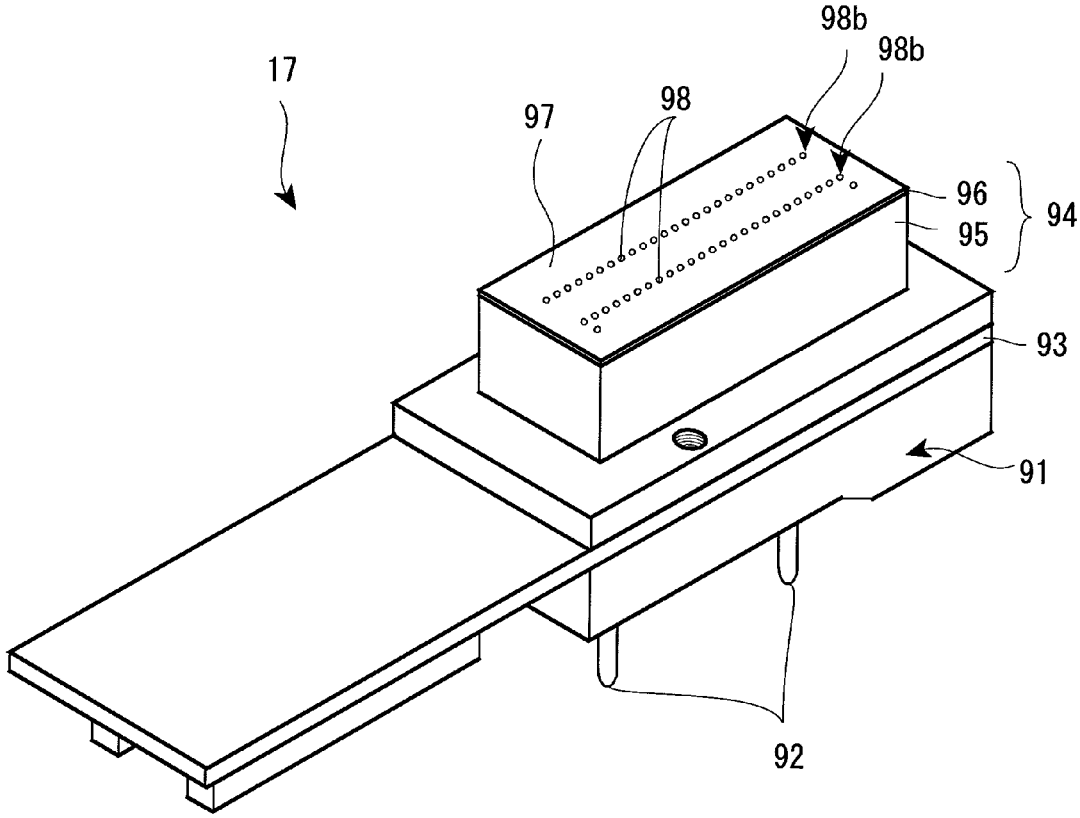
FIG. 5 is a perspective view of the functional liquid droplet ejection head.

As shown in FIG. 5, each of the functional liquid droplet ejection heads 17 is a so-called twin-type head, and includes a functional liquid introduction part 91 having two connecting needles 92, two head boards 93 coupled to the functional liquid introduction part 91, and a head body 94 coupled downward to the functional liquid introduction part 91 and being formed with an in-head channel filled with the functional liquid therein. The connecting needles 92 are connected to the functional liquid supplying unit 7 and supply the functional liquid introduction part 91 with the functional liquid. The head body 94 includes a cavity 95 (piezoelectric element) and a nozzle plate 96 having a nozzle surface 97 with a number of ejection nozzles 98 opened therethrough. When the functional liquid droplet ejection heads 17 are driven for ejection, (by means of a voltage applied to the piezoelectric element) functional liquid droplets are ejected from the ejection nozzles 98 by a pumping action of the cavity 95.

The nozzle surface 97 has two split nozzle rows 98*b* with a number of ejection nozzles 98 that are arranged in parallel to each other. The two split nozzle rows 98*b* are arranged so as to be displaced by a half nozzle pitch.

The chamber 6 keeps the temperature and humidity therein constant. Specifically, the liquid droplet ejection apparatus 1 performs plotting on the workpiece W under an atmosphere of fixed temperature and humidity. A tank cabinet 84 is disposed at a part of a side wall of the chamber 6 to accommodate main tanks 181, etc. It is preferable that an atmosphere in the chamber 6 be filled with inert gas (nitrogen gas) when organic electroluminescence devices and the like are manufactured.

As shown FIGS. 1 and 2, a maintenance area 213 is an area with the wiping unit 16 and the suction unit 15 on which ten (plural) cap units 303 are mounted. When the operation of the liquid droplet ejection apparatus 1 is stopped, ten carriage units 51 are moved to the position of the suction unit 15 (ten cap units 303) by means of the Y-axis table 12 to cap all the functional liquid droplet ejection heads 17, so-called capping. On the other hand, when the operation is started, all the functional liquid droplet ejection heads 17 are sucked and subsequently wiped in units of carriage units 51, and then ten carriage units 51 are sequentially moved to a plotting area 214 on the X-axis table 11.

Further, if ejection failure is detected at the third carriage unit 51 from the maintenance area 213 side in operation, for example, three, the first to third, carriage units 51 therefrom are moved onto three, the first to third, cap units 303 from the plotting area 214 side. Then, while one relevant carriage unit 51 is subjected to the suction process by a corresponding cap unit 303, the other two carriage units 51 is subjected to the ejection for maintenance (flushing) from the respective functional liquid droplet ejection heads 17 to the cap units 303. As such, ten carriage units 51 are individually controlled so that ten cap units 303 can be subjected to the appropriate processes.

Next, the suction unit 15 will be described with reference to FIGS. 6 and 7. The suction unit 15 includes ten cap units 303 having twelve head caps 301 corresponding to twelve functional liquid droplet ejection heads 17 disposed on a cap plate 302; ten supports 305 that support the cap units 303; ten lifting/lowering mechanisms (contacting/separating mechanisms) 306 that lift and lower the cap units 303 using the supports 305; and six pairs of suction mechanisms 100 (see FIG. 8) coupled to the head caps 301 and corresponding to six pairs of the functional liquid droplet ejection heads 17 each of which pair provides a different color.

Further, the suction unit 15 includes a compressed air supply system 85 that supplies a pressure control mechanism 103, which will be described later, for example, with compressed air for control, an exhaust system 87 that exhausts gas from respective parts, and a waste functional liquid treatment system 89 that is connected to a waste liquid tank 101, which will be described later, and drains the functional liquid reserved therein. The suction device as defined in the claims is composed of the cap unit 303 (a head cap 301 corresponding to a functional liquid droplet ejection head 17 of a color), the support 305, the lifting/lowering mechanism 306, and the suction mechanism 100 corresponding to the color. That is, the suction devices in this embodiment have common supports 305 and lifting/lowering mechanisms 306 to conduct contacting/separating operations in units of the cap units 303.

Figure 6:
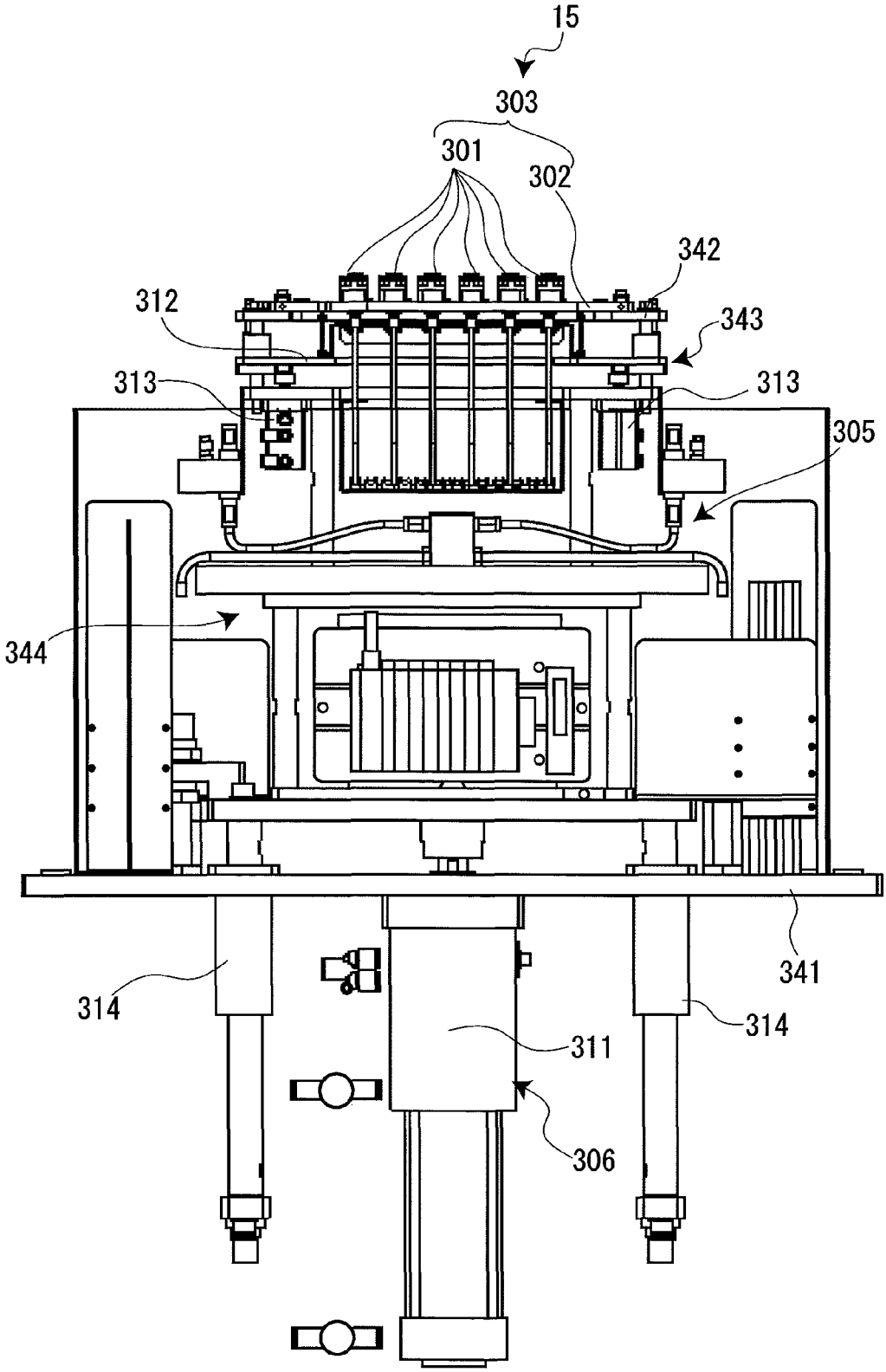
FIG. 6 is a sectional view of a cap unit and the vicinity thereof.

As shown in FIG. 6, the lifting/lowering mechanism 306 has a lifting/lowering cylinder 311 that directly lifts and lowers the head caps 301 using the supports 305, a pair of linear guides 314 that guides lifting/lowering operations of the lifting/lowering cylinder 311, and a base 341 that supports these components. The lifting/lowering cylinder 311 greatly lowers the head caps 301 for exchanging the head unit 13, and also contacts and moves the head caps 301 with and away from the nozzle surface 97 of the functional liquid droplet ejection heads 17. Specifically, the lifting/lowering cylinder 311 lifts and lowers the cap units 303 among three levels as follows: a close position for suction, a spaced position for flushing, and an exchange position for exchanging the head units 13 or exchanging consumable supplies for the cap units 303 (maintenance).

The support 305 has a support body 343 having a support frame 342 that supports the cap unit 303 at its upper end, an air release mechanism 312 that collectively opens air release valves (not shown) for twelve head caps 301, and a pair of air cylinders 313 that lowers the air release mechanism 312.

Figure 7:
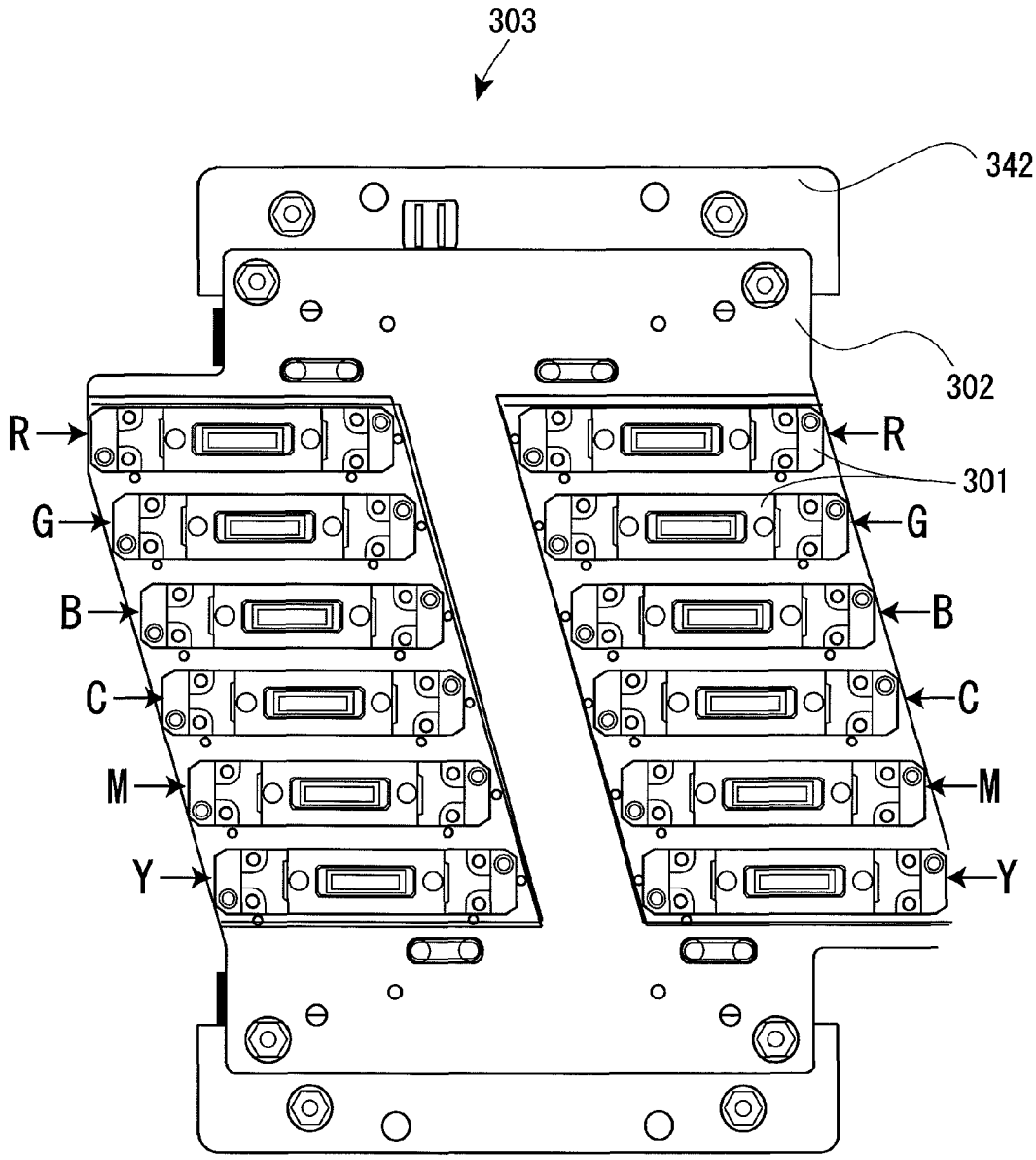
FIG. 7 is a plan view of the cap unit.

As shown in FIG. 7, each cap unit 303 includes twelve head caps 301 and the cap plate 302 having the head caps 301 mounted thereon. The twelve head caps 301 are mounted on the cap plate 302 in the same arrangement as and having the same inclination as the twelve functional liquid droplet ejection heads 17.

Figure 8:
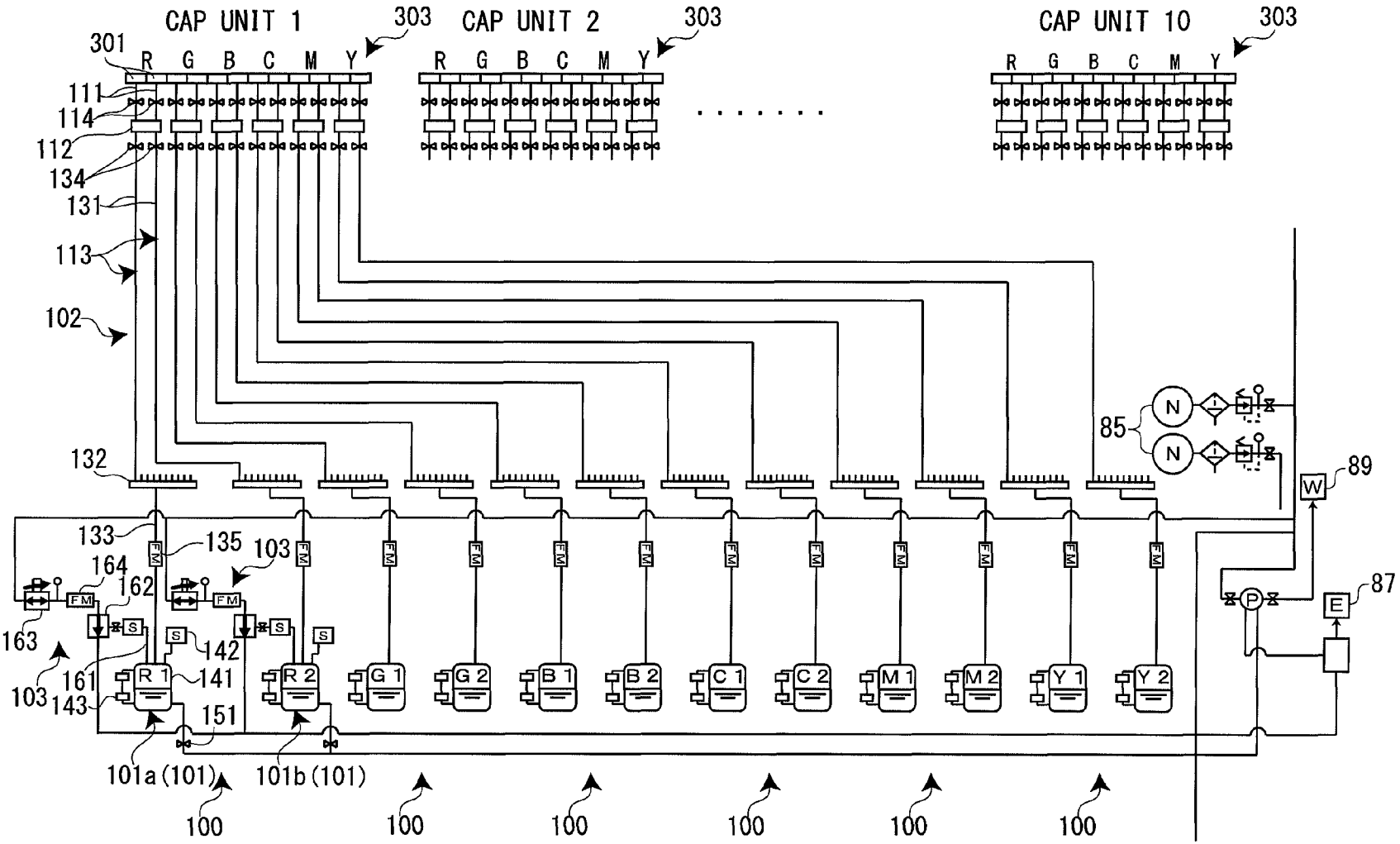
FIG. 8 is a diagram showing a piping system of a suction unit.

The respective cap units 303 have six pairs, namely twelve head caps 301 each of which pairs provides one color corresponding to six pairs, namely twelve functional liquid droplet ejection heads 17 of the head unit 13 each of which pairs has one color. The suction mechanism 100 according to this embodiment can individually perform the suction process by the colors. Specifically, as shown in FIG. 8, the head caps 301 are connected to individual separate six pairs of the suction mechanisms 100 corresponding to the six-color functional liquid droplet ejection heads 17.

Now the suction mechanism 100 will be described taking an example of the suction mechanism 100 for a color red (R) since the configuration and function of the respective suction mechanisms 100 are the same. As shown in FIG. 8, the suction mechanism 100 for red includes a pair of waste liquid tanks 101 that drains red waste functional liquid, a functional liquid suction channel 102 that connects the head caps 301 for red to the pair of waste liquid tanks 101, and a pair of pressure control mechanisms 103 that is connected to the pair of waste liquid tanks 101 and controls inner pressure of the waste liquid tanks 101. The pressure control mechanisms 103 individually adjust the inner pressure of the waste liquid tanks 101 to control the head caps 301 to be under negative pressure (suction) via the functional liquid suction channel 102.

The functional liquid suction channel 102 has twenty cap-side channels (main channels) 111 connected to respective pairs of red head caps 301 of ten cap units 303, ten cap-side junction parts 112 that combine two cap-side channels 111 corresponding to a common cap unit 303, and two sets of tank-side channels 113 that connect their upstream sides to the associated ten cap-side junction parts 112 and their downstream sides to a pair of waste liquid tanks 101. An individual valve 114 is disposed on each of the cap-side channels 111 to individually open/close the connection to the associated head cap 301. The suction channel as defined in the claims is composed of two individual channels 131, as is described below, including two cap-side channels 111 connected to one cap unit, one cap-side junction part 112 positioned downstream of the cap-side channels, and two sets of tank-side channels 113 positioned further downstream of the cap-side junction channels 112.

Each of the tank-side channels 113 includes ten individual channels 131 that connect their upstream sides to the ten cap-side junction parts 112, a tank-side junction part (manifold) 132 that combines the ten individual channels 131 all together, and a junction channel 133 that connects its upstream side to the tank-side junction part 132 and its downstream side to the waste tank 101. Specifically, two individual channels 131 included in two sets of tank-side channels 113 are connected to each of the cap-side junction parts 112. Switching valves 134 are disposed near (branch) the cap-side junction part 112 of the respective two individual channels 131 such that the channel connection to the head cap 301 positioned its upstream side can be switched between the pair of waste liquid tanks 101 positioned downstream sides of the individual channels 131. Further, flowmeters (flow rate detection units) 135 are disposed on the junction channels 133 to detect the flow rate of the functional liquid flowing into the waste liquid tanks 101. The switching valves 134 are simple valves and constitute the channel switching unit when one valve is open and the other is closed. Also, when both valves are closed, the channel connection to the head caps 301 can be blocked. Further, the tip end of the junction channel 133 is deeply inserted into the vicinity of the bottom of the waste liquid tanks 101. Furthermore, the channel opening/closing unit as defined in the claims is composed of the switching valves 134. The channel switching unit and the channel opening/closing unit are composed of the switching valves 134 in the embodiment, however, the channel switching unit and the channel opening/closing unit may be composed of separate open/close valves.

The tank-side junction channel 132 is formed like a funnel of which upper end is blocked by a discoidal cover to constitute a disk-shaped manifold. Downstream sides of the ten individual channels 131 are so connected to the cover as to be evenly arranged in the circumferential direction of the disk-shaped manifold.

With this configuration, the plurality of individual channels 131 are so connected to the cover of the manifold formed like a funnel as to be evenly arranged in the circumferential direction, therefore, pressure loss of the individual channels 131 can be equalized in the channels from the plurality of individual channels 131 through the junction channels 133. In other words, if the channel length and diameter of the individual channels 131 are set to be even, the negative pressure (suction force) in the ten cap units 303 sucked thereby can be constant in each waste liquid tank 101.

The waste liquid tank 101 includes a tank body 141 composed of a so-called sealed tank, a pressure gauge (pressure detection unit) 142 connected to an upper space of the tank body 141 to detect inner pressure in the tank, and a liquid level detection unit 143 disposed at a side of the tank body 141 to detect the liquid level of the functional liquid. Also, the waste liquid tank 101 is connected to the waste functional liquid treatment system 89 that drains the reserved functional liquid. The pressure in the waste liquid tank 101 is controlled based on the inner pressure detected by the pressure gauge 142, as will be described later in detail.

The liquid level detection unit 143 detects the liquid level of the reserved functional liquid to detect full and reduced states of the liquid in the tank body 141. If the liquid level of the functional liquid is raised to the upper limit (full state) by the suction process, then a waste liquid valve 151 disposed on a channel of the waste functional liquid treatment system 89 side is opened to drain the functional liquid to the waste functional liquid treatment system 89. The waste liquid valve 151 is opened after the detection of the full state of the liquid and not at the time of driving the suction unit 15. When the lowest limit of the liquid level is detected, the waste liquid valve 151 is closed, whereby the state is kept in which the tip end of the junction channel 133 is always inserted into the functional liquid.

The pressure control mechanism 103 includes a communication channel 161 that connects the upper stream side thereof to the upper space of the tank body 141, an ejector 162 connected to the communication channel 161, the compressed air supply system 85 and exhaust system 87, an electro-pneumatic regulator (pressure adjustment unit) 163 that is disposed in channels between the ejector 162 and the compressed air supply system 85 and adjusts the pressure of the compressed air supplied to the ejector 162, and a flow rate sensor 164 disposed adjacent to the electro-pneumatic regulator 163. Specifically, the ejector 162 introduces compressed air to the primary side thereof from the compressed air supply system 85 while connecting the secondary side thereof to the upper space of the waste liquid tank 101. The electro-pneumatic regulator 163 adjusts the pressure to reduce the pressure in the tank body 141 in such a way that the air in the communication channel 161 is drawn to the exhaust system 87 side by the accompanying flow of the compressed air supplied to the ejector 162. In other words, pressure in each waste liquid tank 101 is individually adjusted by the pressure control mechanism 103. The pair of waste liquid tanks 101 are composed of a first waste liquid tank 101*a* for suction and a second waste liquid tank 101*b* for flushing both of which pressures are controlled by the ejector 162 (electro-pneumatic regulator 163).

Figure 9:
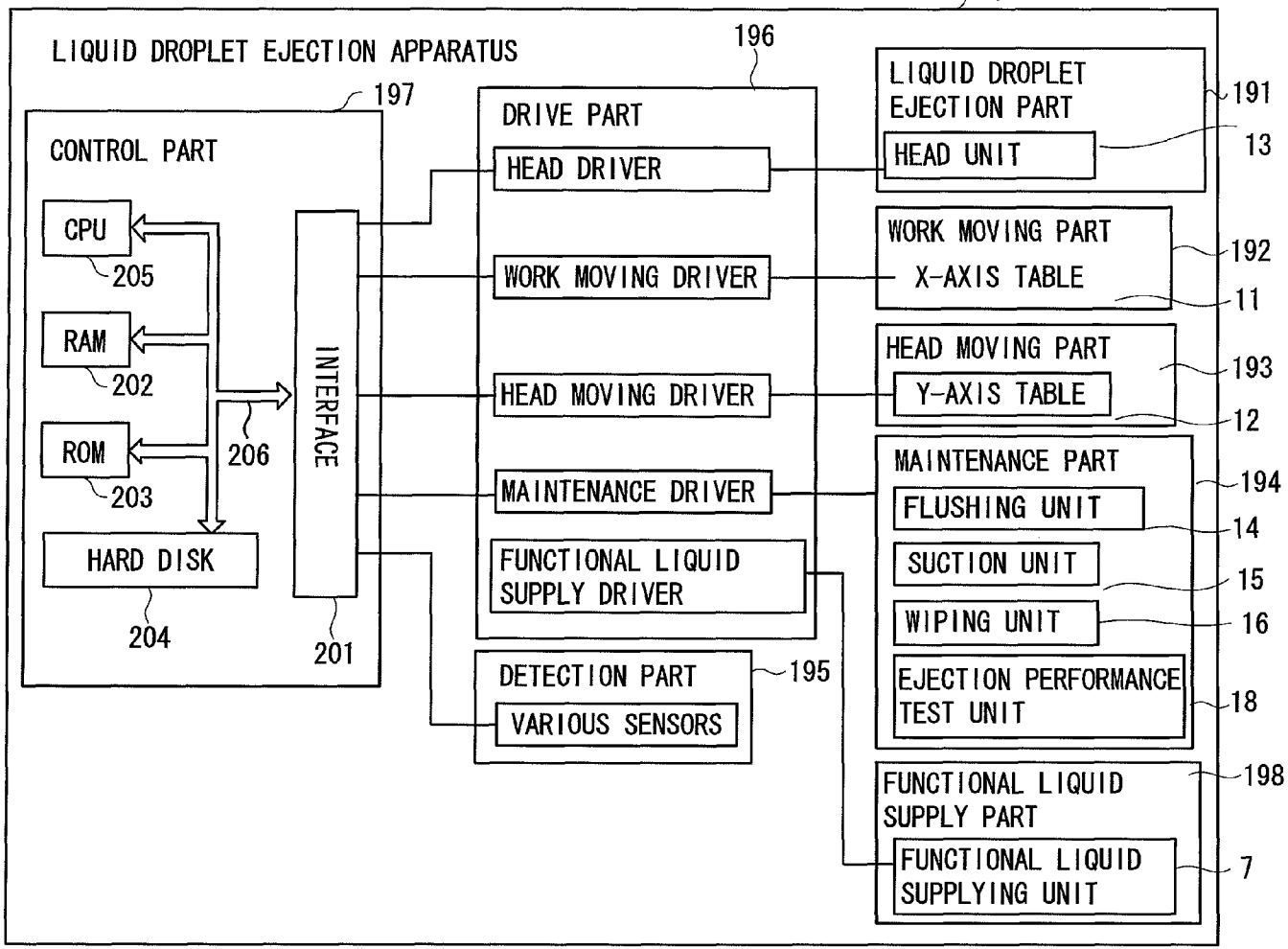
FIG. 9 is a block diagram showing a main control system of the liquid droplet ejection apparatus.

Next, the main control system of the liquid droplet ejection apparatus 1 will be described with reference to FIG. 9. The liquid droplet ejection apparatus 1 includes a liquid droplet ejection part 191 having a head unit 13 (functional liquid droplet ejection heads 17), a work-moving part 192 that has the X-axis table 11 and moves a workpiece W in the X-axis direction, a head-moving part 193 that has the Y-axis table 12 and moves the head unit 13 in the Y-axis direction, a maintenance part 194 that has each of the maintenance units, a functional liquid supply part 198 that has the functional liquid supplying unit 7 and supplies the functional liquid droplet ejection heads 17 with functional liquid, a detection part 195 that has various sensors and performs various detection operations, a drive part 196 that has various drivers to drive and control each part, and a control part (control unit) 197 that is connected to each part and controls the whole liquid droplet ejection apparatus 1.

The control part 197 includes an interface 201 for connecting respective units, a RAM 202 that has a storage area capable of temporarily storing information and is used as a working area for the control, a ROM 203 that has various storage areas and stores control programs and data, a hard disk 204 that stores plotting data to plot a predetermined plotting pattern on the workpiece W and various data from the units, as well as programs to process various data and the like, a CPU 205 that processes various data according to the programs stored in the ROM 203 and the hard disk 204, and a bus 206 that interconnects these components.

The control part 197 inputs various data from the units via the interface 201, and also causes the CPU 205 to process the data according to the programs stored in the hard disk 204 (or sequentially read from a CD-ROM drive and the like) to output the result to respective units via the drive part 196 (various drivers). This allows the entire apparatus to be controlled to perform various processes of the liquid droplet ejection apparatus 1.

A concurrent process of the suction processes for suction and flushing by the suction unit 15 will now be described. Desired processes in the suction processes for suction and flushing are simultaneously performed to the carriage units 51 (functional liquid droplet ejection heads 17) in this concurrent process. Basically, the suction for suction is high-pressured suction (large negative pressure) and the suction for flushing is low-pressured suction (small negative pressure). Here, an example is described in which five carriage units 51 out of the ten carriage units 51 are subjected to the flushing and the other five carriage units 51 are subjected to the suction.

The carriage units 51 that perform the suction process for suction move the cap units 303 to a close position with their corresponding lifting/lowering mechanisms 306, while controlling the switching valves 134 to switch the channel connection to the relevant cap units 303 to the first waste liquid tank 101*a* for suction (tank-side channels 113 at the first waste liquid tank 101*a* side).

The other five carriage units 51 that perform the suction process for flushing move five cap units 303 to a spaced position with their corresponding lifting/lowering mechanisms 306, while controlling the switching valves 134 to switch the channel connection to the relevant cap units 303 to the second waste liquid tank 101*b* for flushing (tank-side channels 113 at the second waste liquid tank 101*b* side).

The concurrent process is conducted in these states. In the five carriage units 51 performing the suction, the pressure in the first waste liquid tank 101*a* is appropriately adjusted for the suction process by the pressure control mechanism 103 and the negative pressure is applied (sucked) to the (five) cap units 303 in closely contacting with the carriage units 51. This suction operation includes a suction on initial charge of the functional liquid to the functional liquid droplet ejection heads 17 and a suction for normal functional recovery. These cases are supposed to be performed under an optimum suction pressure derived from experiments. Particularly, the initial charge is controlled (process control) such that suction is conducted with a strong suction force in the initial suction stage to exclude air bubbles in the channels, and suction is conducted with a weak suction force in the final suction stage.

On the other hand, the other five carriage units 51 performing the flushing are subjected to the ejection for maintenance by the functional liquid droplet ejection heads 17, and the pressure in the second waste liquid tank 101*b* is appropriately adjusted for the flushing by the pressure control mechanism 103 to perform suction of the (five) cap units 303 in spaced away from the carriage units 51. This suction process includes a suction of the functional liquid accumulated in the head caps 301 resulting from the flushing, as well as a suction of mist of functional liquid droplets resulting from the flushing to the head caps 301 together with ambient air. Therefore, the flushing is started after (several seconds) the suction operation is started by the suction mechanism 100 and the suction operation is finished after (several seconds) the flushing is finished. The suction pressure (negative pressure) level is set to be capable of sucking the functional liquid from a functional liquid absorber of the head cap 301 and to an extent that the functional liquid forming a meniscus of the ejection nozzle 98 is not dried out by the ambient air flow.

As such, the plurality of cap units 303 can be communicated with the plurality of waste liquid tanks 101 with different levels of suction pressure in units of the cap units 303 by selectively switching the channel of the functional liquid suction channel 102 to any one of the waste liquid tanks 101 by the pair of switching valves 134. Specifically, in the suction process, high or low suction pressure can be selectively applied to the functional liquid droplet ejection heads 17 via the head caps 301 in units of the cap units 303. This allows the suction process to be conducted by concurrently applying different levels of suction pressure to the cap units 303. Further, since the suction process is applied to the plurality of cap units 303 in each of the suction units (waste liquid tanks 101 and pressure control mechanism 103), the number of the suction units can be decreased as compared with the case of providing suction units in units of the cap units 303, whereby improvement in space efficiency and simple structure can be achieved.

The suction units are composed of the waste liquid tanks 101 and ejector 162, therefore the structure of the suction units can be simplified while having excellent chemical resistance to the functional liquid.

Furthermore, each of the suction units has an electro-pneumatic regulator 163 that adjusts the pressure of the compressed air supplied to the ejector 162 and is controlled by the control part 197. Accordingly, the negative pressure for suction (suction pressure) to be introduced into the waste liquid tanks 101 can be easily adjusted in consideration of viscosity of functional liquid or suction manners. It is needless to say that adjustment can be easily made even in a case where a different type of functional liquid is newly introduced or a case where a suction manner is altered.

Further, one suction unit (first waste liquid tank 101*a* and its pressure control mechanism 103) is sucked with the head caps 301 closely contact with the functional liquid droplet ejection heads 17, while the other suction unit (second waste liquid tank 101*b* and its pressure control mechanism 103) is sucked with the head caps 301 spaced away from the functional liquid droplet ejection heads 17, whereby one suction unit can be a unit for functional recovery which sucks the functional liquid from the functional liquid droplet ejection heads 17 and the other suction unit can be a unit for functional maintenance which sucks the functional liquid ejected for maintenance from the functional liquid droplet ejection heads 17. This allows the suction units to be appropriately selected according to a state such as clogging at the functional liquid droplet ejection heads 17.

An example has been explained in which five carriage units 51 are subjected to the suction for suction and the other five carriage units 51 are subjected to the suction for flushing. However, selection of suction processes to the carriage units 51 can be made by the pair of switching valves 134 as mentioned above. The pressure control of the waste liquid tanks 101 by the electro-pneumatic regulator 163 is conducted based on an open/close state of the switching valves 134 (the number of opening) and a detection value by the pressure gauge 142, since appropriate pressure of the waste liquid tanks 101 (appropriate pressure for flushing or for suction) depends on the number of the head caps 301 connected to the channels. Determination whether flushing or suction is performed is made based on the test result from the ejection performance test unit 18.

First, the number of the head caps 301 connected to channels is calculated based on the number of the cap units 303 connected to the channels of the waste liquid tanks 101 with the switching valves 134 (the number of opening of the switching valves 134 connected to the tank-side channels 113 of the waste liquid tank 101 that is subjected to the pressure control is doubled). The appropriate pressure is obtained from a coefficient table previously derived from experiments using the calculated number of the head caps 301. Thereafter, the electro-pneumatic regulator 163 is controlled such that the pressure in the waste liquid tank 101 detected by the pressure gauge 142 is at an appropriate level of pressure (feedback control).

Accordingly, the electro-pneumatic regulator 163 is controlled depending on the number of opening of the switching valves 134, therefore, the suction pressure in the cap units 303 (head caps 301) can be constant. This makes the suction flow rates of the cap units 303 (head caps 301) constant independent of the number of the functional liquid droplet ejection heads 17 which conduct a suction process. The suction pressure can be controlled to be constant in any of the cap unit 303 (head caps 301) by controlling the electro-pneumatic regulator 163 based on the detection value of the pressure gauge 142, whereby the suction process can be appropriately applied to the functional liquid droplet ejection heads 17 in consideration of the types of functional liquid. It is preferable that an appropriate pressure be set to the coefficient table based on the viscosity of relevant functional liquid in addition to the number of the head caps 301.

In the above example of the suction operation, the method in which the electro-pneumatic regulator 163 is controlled based on the detection value of the pressure gauge 142 is used. However, the following method may be used.

In this alternative control method, the flowmeter 135 is used to control the electro-pneumatic regulator 163. The appropriate flow rate of the functional liquid is obtained, then the pressure control of the electro-pneumatic regulator 163 is adjusted for an appropriate flow rate of the functional liquid flowing into the waste liquid tanks 101 (feedback control).

With this configuration, the suction pressure can be controlled to be constant in any cap units 303 (head caps 301) by controlling the electro-pneumatic regulator 163 according to the flowmeter 135 similarly to the case of using the pressure gauge 142, whereby the suction process can be appropriately applied to the functional liquid droplet ejection heads 17 in consideration of the types of functional liquids.

Although the liquid droplet ejection apparatus 1 having the ten carriage units 51 is used in the above-described embodiment, the numbers of the carriage units 51 and the functional liquid droplet ejection heads 17 mounted on each of the carriage units 51 are optional.

Also, the functional liquid droplet ejection heads 17 which supply functional liquid of six colors, namely R (red), G (green), B (blue), C (cyan), M (magenta), and Y (yellow) are used in the embodiment. However, the number and types of colors of functional liquid supplied are optional, and the present invention can be applied to a liquid droplet ejection apparatus 1 that supplies functional liquid of three colors of RGB, a single color, six colors of R, G, B, LR (light red), LG (light green), and LB (light blue), for example. Further, ten sets of the suction devices are used in the embodiment, however, the number thereof is optional and a single suction device may be used. Furthermore, the ten cap units 303 are provided corresponding to the ten carriage units 51 in the embodiment, however, a single head cap 301 may be mounted on the respective cap units 303 to use 10×12 cap units 303 corresponding to 10×12 functional liquid droplet ejection heads 17, for example. In such a case, it is necessary to have 10×12 supports 305 that support the cap units 303, and 10×12 lifting/lowering mechanisms 306 that lift and lower the cap units 303 by using the supports 305. With this configuration, the suction and flushing processes can be selected by using the functional liquid droplet ejection heads 17 (respective head caps 301) in the concurrent process.

Taking electro-optical apparatuses (flat panel display apparatuses) manufactured using the liquid droplet ejection apparatus 1 and active matrix substrates formed on the electro-optical apparatuses as display apparatuses as examples, configurations and manufacturing methods thereof will now be described. Examples of the electro-optical apparatuses include a color filter, a liquid crystal display apparatus, an organic EL apparatus, a plasma display apparatus (PDP (plasma display panel) apparatus), and an electron emission apparatus (FED (field emission display) apparatus and SED (surface-conduction electron emitter display) apparatus). Note that the active matrix substrate includes thin-film transistors, source lines and data lines which are electrically connected to the thin film transistors.

Figure 10:
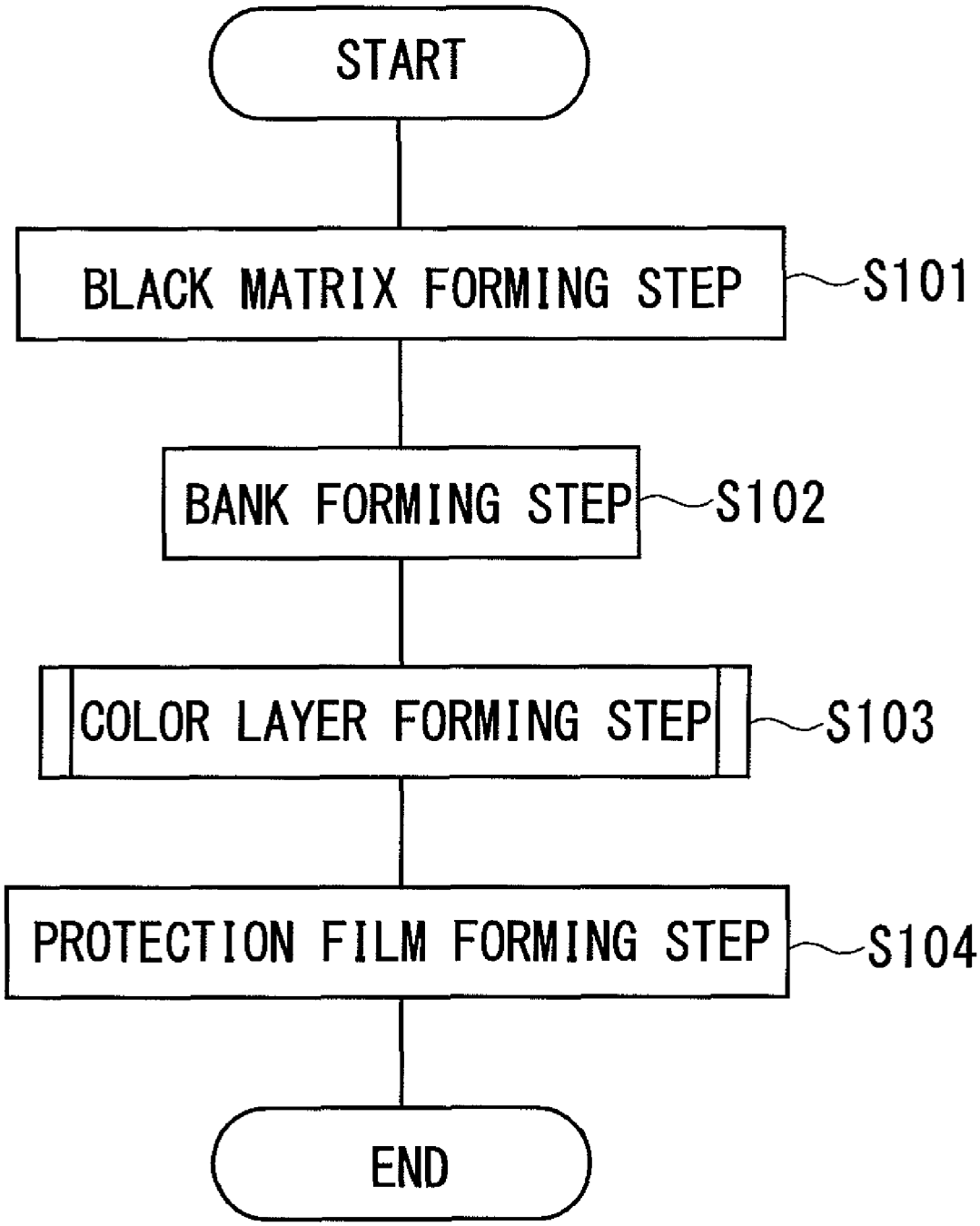
FIG. 10 is a flowchart illustrating manufacturing steps of a color filter.

First, a manufacturing method of a color filter incorporated in a liquid crystal display apparatus or an organic EL apparatus will be described. FIG. 10 shows a flowchart illustrating manufacturing steps of a color filter. FIGS. 11A to 11E are sectional views of the color filter 500 (a filter substrate 500A) of this embodiment shown in an order of the manufacturing steps.

Figure 11A:
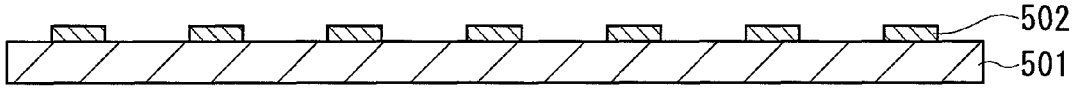
FIGS. 11A-11E are schematic sectional views in an order of manufacturing process for the color filter.

In a black matrix forming step (step S101), as shown in FIG. 11A, a black matrix 502 is formed on the substrate (W) 501. The black matrix 502 is formed of a chromium metal, a laminated body of a chromium metal and a chromium oxide, or a resin black, for example. The black matrix 502 may be formed of a thin metal film by a sputtering method or a vapor deposition method. Alternatively, the black matrix 502 may be formed of a thin resin film by a gravure plotting method, a photoresist method, or a thermal transfer method.

Figure 11B:
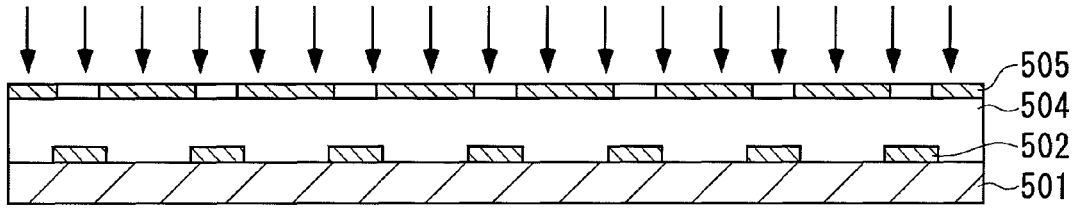

In a bank forming step (step S102), the bank 503 is formed so as to be superposed on the black matrix 502. Specifically, as shown in FIG. 11B, a resist layer 504 which is formed of a transparent negative photosensitive resin is formed so as to cover the substrate 501 and the black matrix 502. An upper surface of the resist layer 504 is covered with a mask film 505 formed in a matrix pattern. In this state, exposure processing is performed.

Figure 11C:
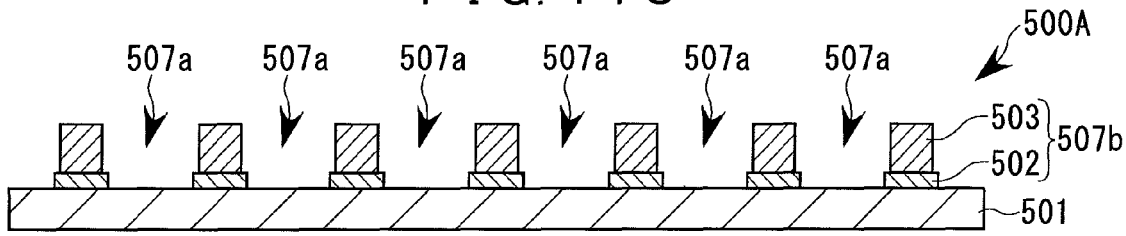

Furthermore, as shown in FIG. 11C, the resist layer 504 is patterned by performing etching processing on portions of the resist layer 504 which are not exposed, and the bank 503 is thus formed. Note that when the black matrix 502 is formed of a resin black, the black matrix 502 also serves as a bank.

The bank 503 and the black matrix 502 disposed beneath the bank 503 serve as a partition wall 507*b* for partitioning the pixel areas 507*a*. The partition wall 507*b* defines receiving areas for receiving the functional liquid ejected when the functional liquid droplet ejection heads 17 form coloring layers (film portions) 508R, 508G, and 508B in a subsequent coloring layer forming step.

The filter substrate 500A is obtained through the black matrix forming step and the bank forming step.

Note that, in this embodiment, a resin material having a lyophobic (hydrophobic) film surface is used as a material of the bank 503. Since a surface of the substrate (glass substrate) 501 is lyophilic (hydrophilic), variation of positions to which the liquid droplet is projected in the each of the pixel areas 507*a* surrounded by the bank 503 (partition wall 507*b*) can be automatically corrected in the subsequent coloring layer forming step.

Figure 11D:
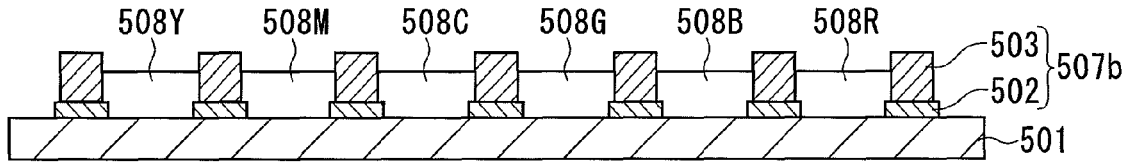

In the coloring layer forming step (S103), as shown in FIG. 11D, the functional liquid droplet ejection heads 17 eject the functional liquid within the pixel areas 507*a* each of which are surrounded by the partition wall 507*b*. In this case, the functional liquid droplet ejection heads 17 eject functional liquid droplets using functional liquid (filter materials) of colors R, G, and B. A color scheme pattern of the three colors R, G, and B may be the stripe arrangement, the mosaic arrangement, or the delta arrangement.

Figure 11E:
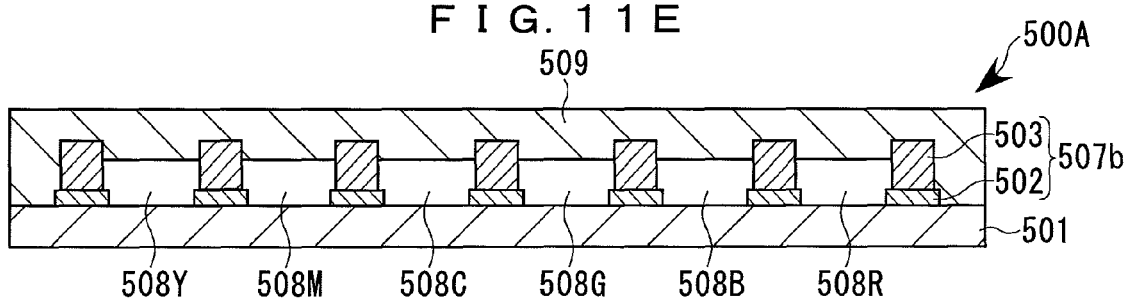

Then drying processing (such as heat treatment) is performed so that the three color functional liquid are fixed, and thus three coloring layers 508R, 508G, and 508B are formed. Thereafter, a protective film forming step is reached (step S104). As shown in FIG. 11E, a protective film 509 is formed so as to cover surfaces of the substrate 501, the partition wall 507*b*, and the three coloring layers 508R, 508G, and 508B.

That is, after liquid used for the protective film is ejected onto the entire surface of the substrate 501 on which the coloring layers 508R, 508G, and 508B are formed and the drying process is performed, the protective film 509 is formed.

In the manufacturing method of the color filter 500, after the protective film 509 is formed, a coating step is performed in which ITO (Indium Tin Oxide) serving as a transparent electrode in the subsequent step is coated.

Figure 12:
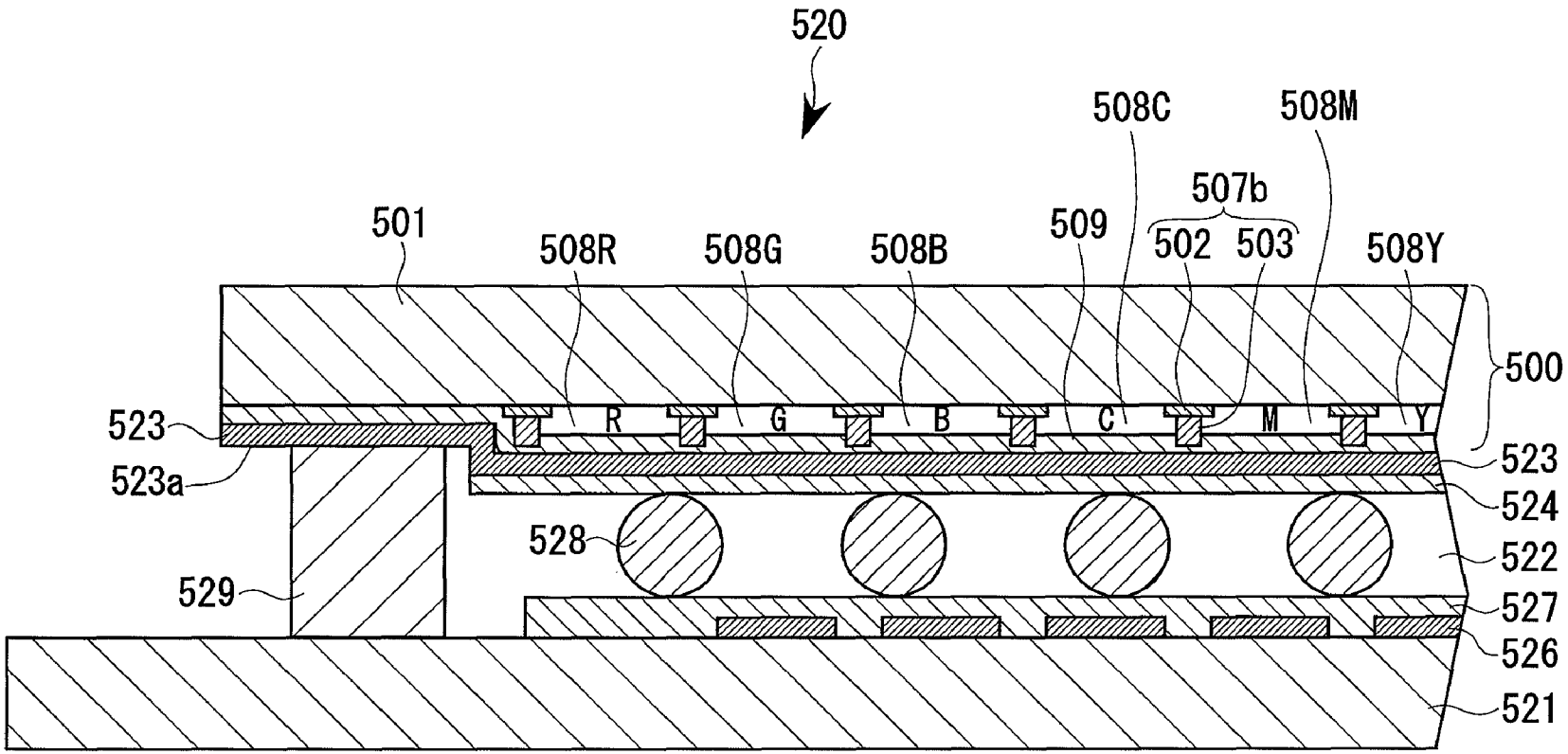
FIG. 12 is a sectional view of an essential part of a liquid crystal display using the color filter according to the invention.

FIG. 12 is a sectional view of an essential part of a passive matrix liquid crystal display apparatus (liquid crystal display apparatus 520) and schematically illustrates a configuration thereof as an example of a liquid crystal display apparatus employing the color filter 500. A transmissive liquid crystal display apparatus as a final product can be obtained by disposing a liquid crystal driving IC (integrated circuit), a backlight, and additional components such as supporting members on the display apparatus 520. Note that the color filter 500 is the same as that shown in FIGS. 11A to 11E, and therefore, reference numerals the same as those used in FIGS. 11A to 11E to denote the same components, and descriptions thereof are omitted.

The display apparatus 520 includes the color filter 500, a counter substrate 521 such as a glass substrate, and a liquid crystal layer 522 formed of STN (super twisted nematic) liquid crystal compositions sandwiched therebetween. The color filter 500 is disposed on the upper side of FIG. 13 (on an observer side).

Although not shown, polarizing plates are disposed so as to face an outer surface of the counter substrate 521 and an outer surface of the color filter 500 (surfaces which are remote from the liquid crystal layer 522). A backlight is disposed so as to face an outer surface of the polarizing plate disposed near the counter substrate 521.

A plurality of rectangular first electrodes 523 extending in a horizontal direction in FIG. 12 are formed with predetermined intervals therebetween on a surface of the protective film 509 (near the liquid crystal layer 522) of the color filter 500. A first alignment layer 524 is arranged so as to cover surfaces of the first electrodes 523 which are surfaces remote from the color filter 500.

On the other hand, a plurality of rectangular second electrodes 526 extending in a direction perpendicular to the first electrodes 523 disposed on the color filter 500 are formed with predetermined intervals therebetween on a surface of the counter substrate 521 which faces the color filter 500. A second alignment layer 527 is arranged so as to cover surfaces of the second electrodes 526 near the liquid crystal layer 522. The first electrodes 523 and the second electrodes 526 are formed of a transparent conductive material such as an ITO.

A plurality of spacers 528 disposed in the liquid crystal layer 522 are used to maintain the thickness (cell gap) of the liquid crystal layer 522 constant. A seal member 529 is used to prevent the liquid crystal compositions in the liquid crystal layer 522 from leaking to the outside. Note that an end of each of the first electrodes 523 extends beyond the seal member 529 and serves as wiring 523*a*.

Pixels are arranged at intersections of the first electrodes 523 and the second electrodes 526. The coloring layers 508R, 508G, and 508B are arranged on the color filter 500 so as to correspond to the pixels.

In normal manufacturing processing, the first electrodes 523 are patterned and the first alignment layer 524 is applied on the color filter 500 whereby a first half portion of the display apparatus 520 on the color filter 500 side is manufactured. Similarly, the second electrodes 526 are patterned and the second alignment layer 527 is applied on the counter substrate 521 whereby a second half portion of the display apparatus 520 on the counter substrate 521 side is manufactured. Thereafter, the spacers 528 and the seal member 529 are formed on the second half portion, and the first half portion is attached to the second half portion. Then, liquid crystal to be included in the liquid crystal layer 522 is injected from an inlet of the seal member 529, and the inlet is sealed. Finally, the polarizing plates and the backlight are disposed.

The liquid droplet ejection apparatus 1 of this embodiment may apply a spacer material (functional liquid) constituting the cell gap, for example, and uniformly apply liquid crystal (functional liquid) to an area sealed by the seal member 529 before the first half portion is attached to the second half portion. Furthermore, the seal member 529 may be printed using the functional liquid droplet ejection heads 17. Moreover, the first alignment layer 524 and the second alignment layer 527 may be applied using the functional liquid droplet ejection heads 17.

Figure 13:
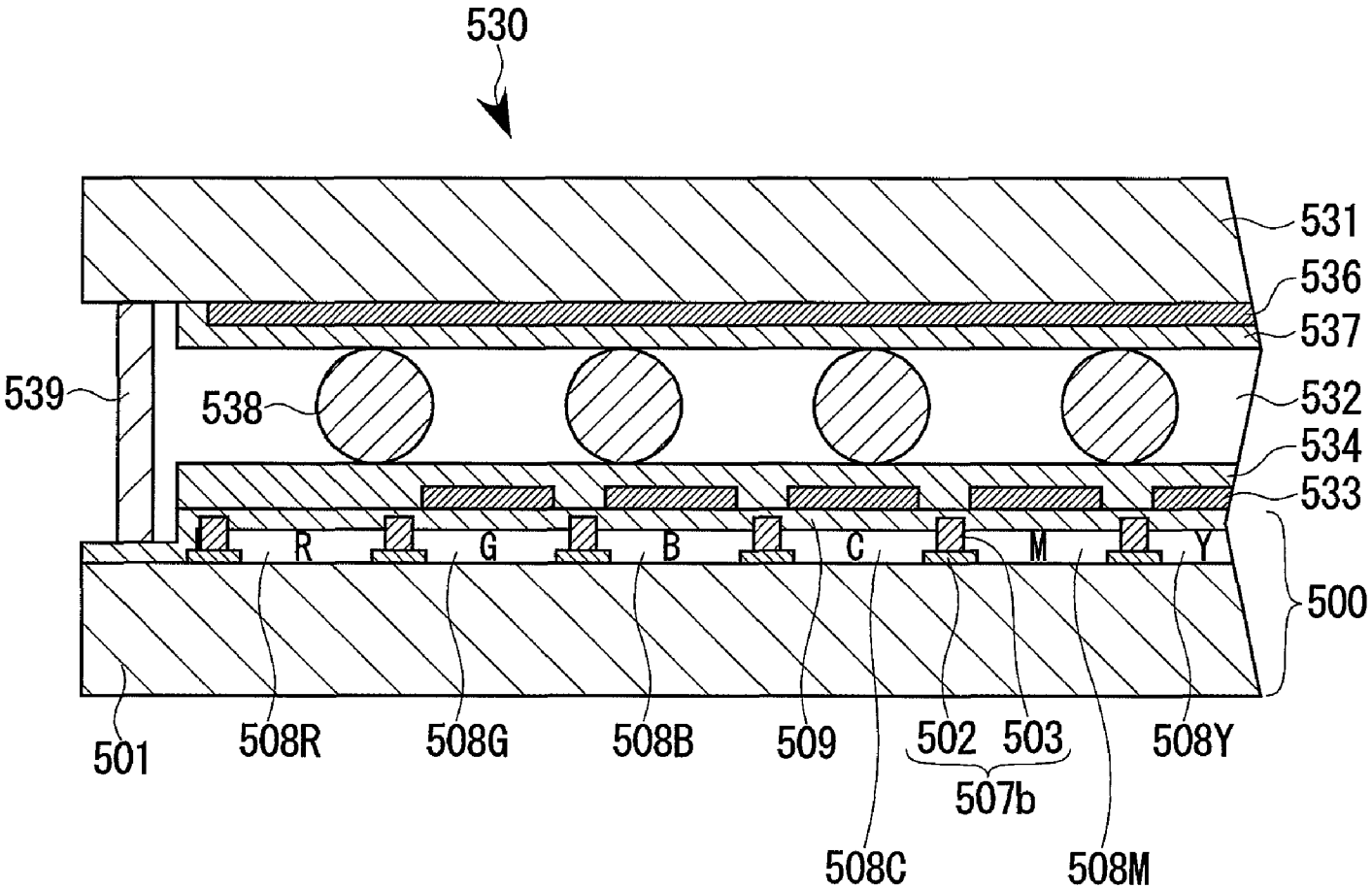
FIG. 13 is a sectional view of an essential part of a liquid crystal display as the second example using the color filter according to the invention.

FIG. 13 is a sectional view of an essential part of a display apparatus 530 and schematically illustrates a configuration thereof as a second example of a liquid crystal display apparatus employing the color filter 500 which is manufactured in this embodiment.

The display apparatus 530 is considerably different from the display apparatus 520 in that the color filter 500 is disposed on a lower side in FIG. 13 (remote from the observer).

The display apparatus 530 is substantially configured such that a liquid crystal layer 532 constituted by STN liquid crystal is arranged between the color filter 500 and a counter substrate 531 such as a glass substrate. Although not shown, polarizing plates are disposed so as to face an outer surface of the counter substrate 531 and an outer surface of the color filter 500.

A plurality of rectangular first electrodes 533 extending in a depth direction of FIG. 13 are formed with predetermined intervals therebetween on a surface of the protective film 509 (near the liquid crystal layer 532) of the color filter 500. A first alignment layer 534 is arranged so as to cover surfaces of the first electrodes 533 which are surfaces near the liquid crystal layer 532.

On the other hand, a plurality of rectangular second electrodes 536 extending in a direction perpendicular to the first electrodes 533 disposed on the color filter 500 are formed with predetermined intervals therebetween on a surface of the counter substrate 531 which faces the color filter 500. A second alignment layer 537 is arranged so as to cover surfaces of the second electrodes 536 near the liquid crystal layer 532.

A plurality of spacers 538 disposed in the liquid crystal layer 532 are used to maintain the thickness (cell gap) of the liquid crystal layer 532 constant. A seal member 539 is used to prevent the liquid crystal compositions in the liquid crystal layer 532 from leaking to the outside.

As with the display apparatus 520, pixels are arranged at intersections of the first electrodes 533 and the second electrodes 536. The coloring layers 508R, 508G, and 508B are arranged on the color filter 500 so as to correspond to the pixels.

Figure 14:
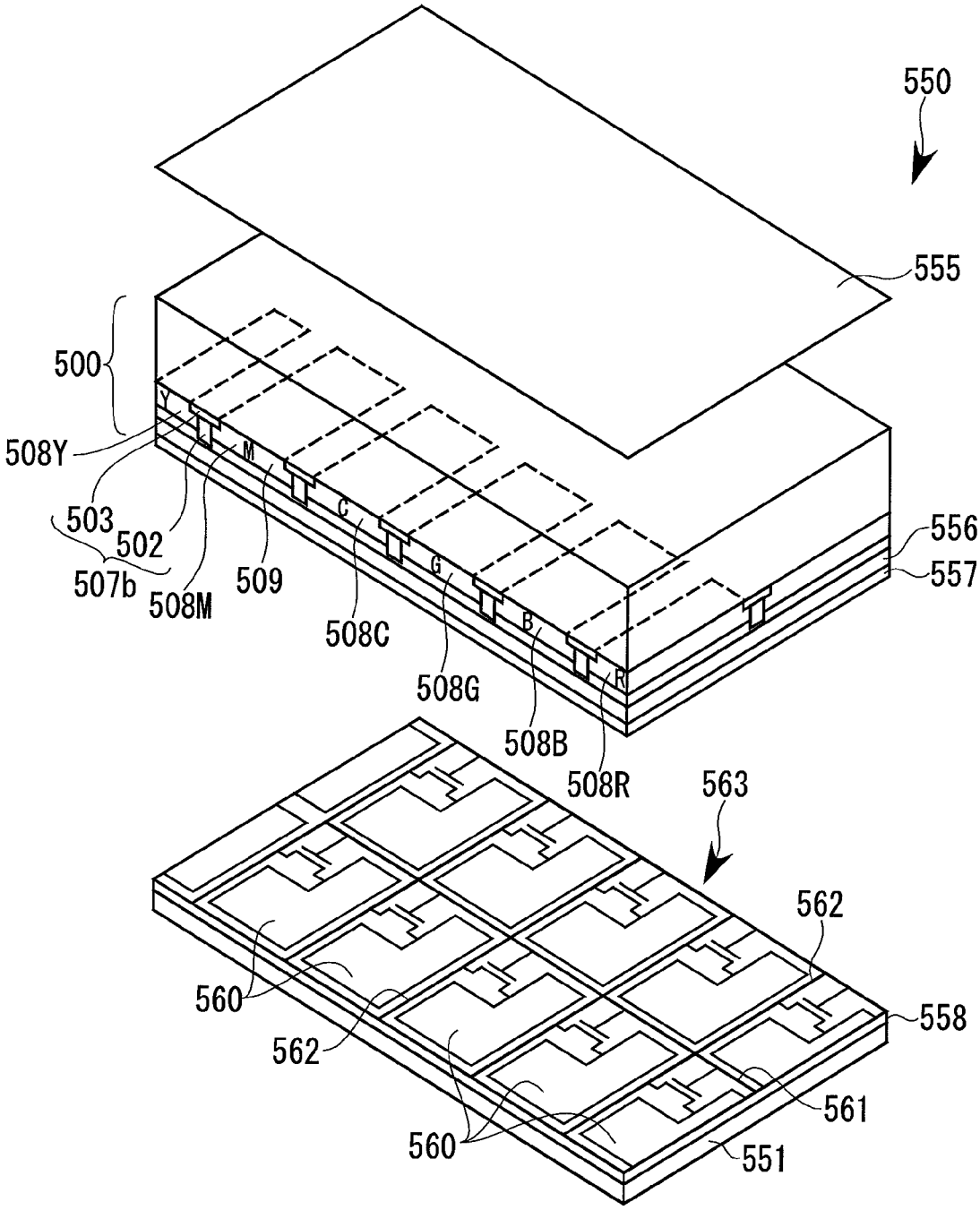
FIG. 14 is a sectional view of an essential part of a liquid crystal display as the third example using the color filter according to the invention.

FIG. 14 is an exploded perspective view of a transmissive TFT (thin film transistor) liquid crystal display device and schematically illustrates a configuration thereof as a third example of a liquid crystal display apparatus employing the color filter 500 to which the invention is applied.

A liquid crystal display apparatus 550 has the color filter 500 disposed on the upper side of FIG. 14 (on the observer side).

The liquid crystal display apparatus 550 includes the color filter 500, a counter substrate 551 disposed so as to face the color filter 500, a liquid crystal layer (not shown) interposed therebetween, a polarizing plate 555 disposed so as to face an upper surface of the color filter 500 (on the observer side), and a polarizing plate (not shown) disposed so as to face a lower surface of the counter substrate 551.

An electrode 556 used for driving the liquid crystal is formed on a surface of the protective film 509 (a surface near the counter substrate 551) of the color filter 500. The electrode 556 is formed of a transparent conductive material such as an ITO and entirely covers an area in which pixel electrodes 560 are to be formed which will be described later. An alignment layer 557 is arranged so as to cover a surface of the electrode 556 remote from the pixel electrode 560.

An insulating film 558 is formed on a surface of the counter substrate 551 which faces the color filter 500. On the insulating film 558, scanning lines 561 and signal lines 562 are arranged so as to intersect with each other. Pixel electrodes 560 are formed in areas surrounded by the scanning lines 561 and the signal lines 562. Note that an alignment layer (not shown) is arranged on the pixel electrodes 560 in an actual liquid crystal display apparatus.

Thin-film transistors 563 each of which includes a source electrode, a drain electrode, a semiconductor layer, and a gate electrode are incorporated in areas surrounded by notch portions of the pixel electrodes 560, the scanning lines 561, and the signal lines 562. When signals are supplied to the scanning lines 561 and the signal lines 562, the thin-film transistors 563 are turned on or off so that power supply to the pixel electrodes 560 is controlled.

Note that although each of the display apparatuses 520, 530, and 550 is configured as a transmissive liquid crystal display apparatus, each of the display apparatuses 520, 530, and 550 may be configured as a reflective liquid crystal display apparatus having a reflective layer or a semi-transmissive liquid crystal display apparatus having a semi-transmissive reflective layer.

Figure 15:
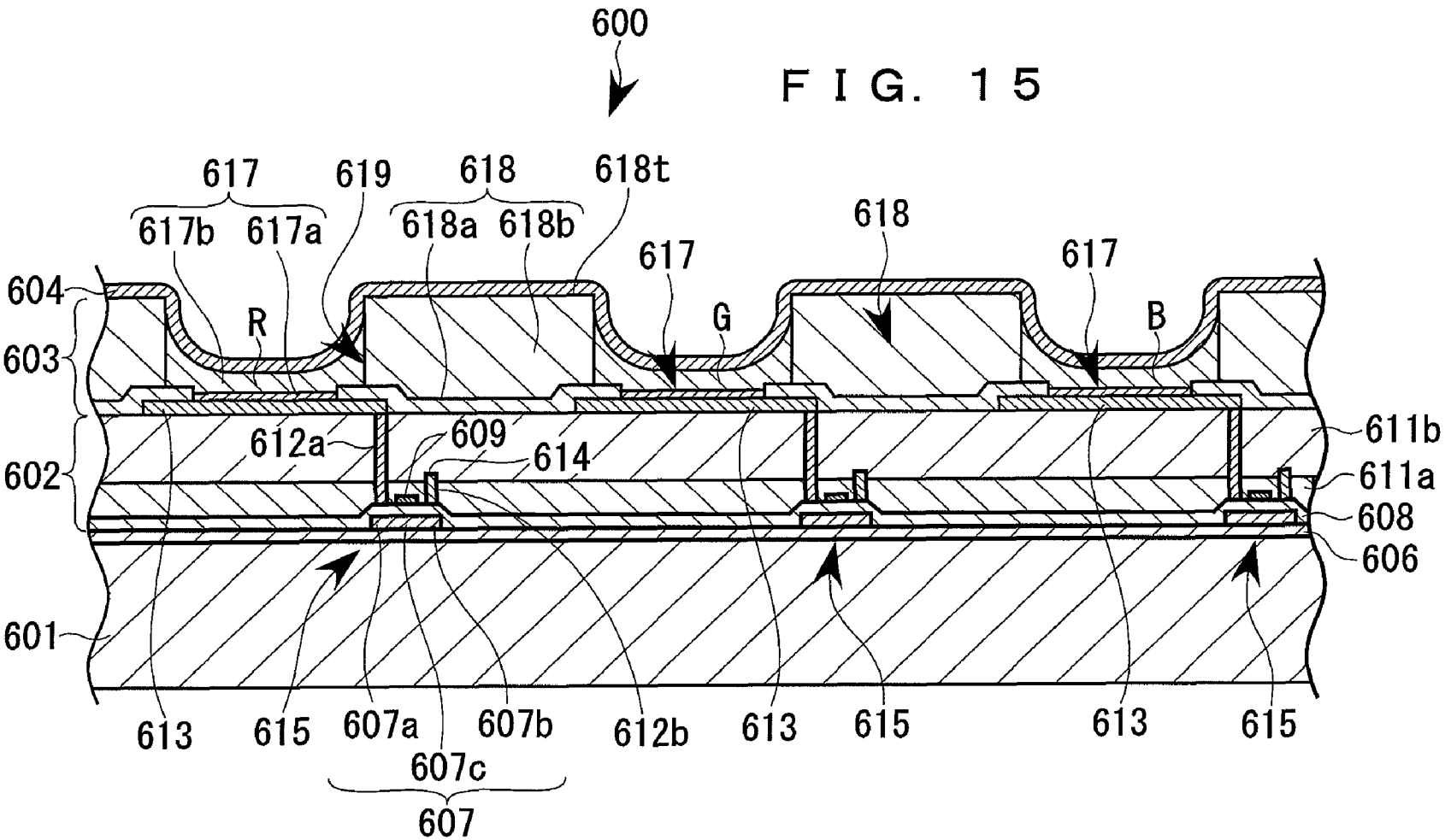
FIG. 15 is a sectional view of an essential part of a display as an organic EL apparatus.

FIG. 15 is a sectional view illustrating an essential part of a display area of an organic EL apparatus (hereinafter simply referred to as a display apparatus 600).

In this display apparatus 600, a circuit element portion 602, a light-emitting element portion 603, and a cathode 604 are laminated on a substrate (W) 601.

In this display apparatus 600, light is emitted from the light-emitting element portion 603 through the circuit element portion 602 toward the substrate 601 and eventually is emitted to an observer side. In addition, light emitted from the light-emitting element portion 603 toward an opposite side of the substrate 601 is reflected by the cathode 604, and thereafter passes through the circuit element portion 602 and the substrate 601 to be emitted to the observer side.

An underlayer protective film 606 formed of a silicon oxide film is arranged between the circuit element portion 602 and the substrate 601. Semiconductor films 607 formed of polysilicon oxide films are formed on the underlayer protective film 606 (near the light-emitting element portion 603) in an isolated manner. In each of the semiconductor films 607, a source region 607*a* and a drain region 607*b* are formed on the left and right sides thereof, respectively, by high-concentration positive-ion implantation. The center portion of each of the semiconductor films 607 which is not subjected to high-concentration positive-ion implantation serves as a channel region 607*c*.

In the circuit element portion 602, the underlayer protective film 606 and a transparent gate insulating film 608 covering the semiconductor films 607 are formed. Gate electrodes 609 formed of, for example, Al, Mo, Ta, Ti, or W are disposed on the gate insulating film 608 so as to correspond to the channel regions 607*c* of the semiconductor films 607. A first transparent interlayer insulating film 611*a* and a second transparent interlayer insulating film 611*b* are formed on the gate electrodes 609 and the gate insulating film 608. Contact holes 612*a* and 612*b* are formed so as to penetrate the first interlayer insulating film 611*a* and the second interlayer insulating film 611*b* and to be connected to the source region 607*a* and the drain region 607*b* of the semiconductor films 607.

Pixel electrodes 613 which are formed of ITOs, for example, and which are patterned to have a predetermined shape are formed on the second interlayer insulating film 611*b*. The pixel electrode 613 is connected to the source region 607*a* through the contact holes 612*a*.

Power source lines 614 are arranged on the first interlayer insulating film 611*a*. The power source lines 614 are connected through the contact holes 612*b* to the drain region 607*b*.

As shown in FIG. 15, the circuit element portion 602 includes thin-film transistors 615 connected to drive the respective pixel electrodes 613.

The light-emitting element portion 603 includes a functional layers 617 each formed on a corresponding one of pixel electrodes 613, and bank portions 618 which are formed between the pixel electrodes 613 and the functional layers 617 and which are used to partition the functional layers 617 from one another.

The pixel electrodes 613, the functional layers 617, and the cathode 604 formed on the functional layers 617 constitute the light-emitting element. Note that the pixel electrodes 613 are formed into a substantially rectangular shape in plan view by patterning, and the bank portions 618 are formed so that each two of the pixel electrodes 613 sandwich a corresponding one of the bank portions 618.

Each of the bank portions 618 includes an inorganic bank layer 618*a* (first bank layer) formed of an inorganic material such as SiO, $SiO_2$, or $TiO_2$, and an organic bank layer 618*b* (second bank layer) which is formed on the inorganic bank layer 618*a* and has a trapezoidal shape in a sectional view. The organic bank layer 618*b* is formed of a resist, such as an acrylic resin or a polyimide resin, which has an excellent heat resistance and an excellent lyophobic characteristic. A part of each of the bank portions 618 overlaps peripheries of corresponding two of the pixel electrodes 613 which sandwich each of the bank portions 618.

Openings 619 are formed between the bank portions 618 so as to gradually increase in size upwardly against the pixel electrodes 613.

Each of the functional layers 617 includes a positive-hole injection/transport layer 617*a* formed so as to be laminated on the pixel electrodes 613 and a light-emitting layer 617*b* formed on the positive-hole injection/transport layer 617*a*. Note that another functional layer having another function may be arranged so as to be arranged adjacent to the light-emitting layer 617*b*. For example, an electronic transport layer may be formed.

The positive-hole injection/transport layer 617*a* transports positive holes from a corresponding one of the pixel electrodes 613 and injects the transported positive holes to the light-emitting layer 617*b*. The positive-hole injection/transport layer 617*a* is formed by ejection of a first composition (functional liquid) including a positive-hole injection/transport layer forming material. The positive-hole injection/transport layer forming material may be a known material.

The light-emitting layer 617*b* is used for emission of light having colors red (R), green (G), or blue (B), and is formed by ejection of a second composition (functional liquid) including a material for forming the light-emitting layer 617*b* (light-emitting material). As a solvent of the second composition (nonpolar solvent), a known material which is insoluble to the positive-hole injection/transport layer 617*a* is preferably used. Since such a nonpolar solvent is used as the second composition of the light-emitting layer 617*b*, the light-emitting layer 617*b* can be formed without dissolving the positive-hole injection/transport layer 617*a* again.

The light-emitting layer 617*b* is configured such that the positive holes injected from the positive-hole injection/transport layer 617*a* and electrons injected from the cathode 604 are recombined in the light-emitting layer 617*b* so as to emit light.

The cathode 604 is formed so as to cover an entire surface of the light-emitting element portion 603, and in combination with the pixel electrodes 613, supplies current to the functional layers 617. Note that a sealing member (not shown) is arranged on the cathode 604.

Steps of manufacturing the display apparatus 600 will now be described with reference to FIGS. 16 to 24.

Figure 16:
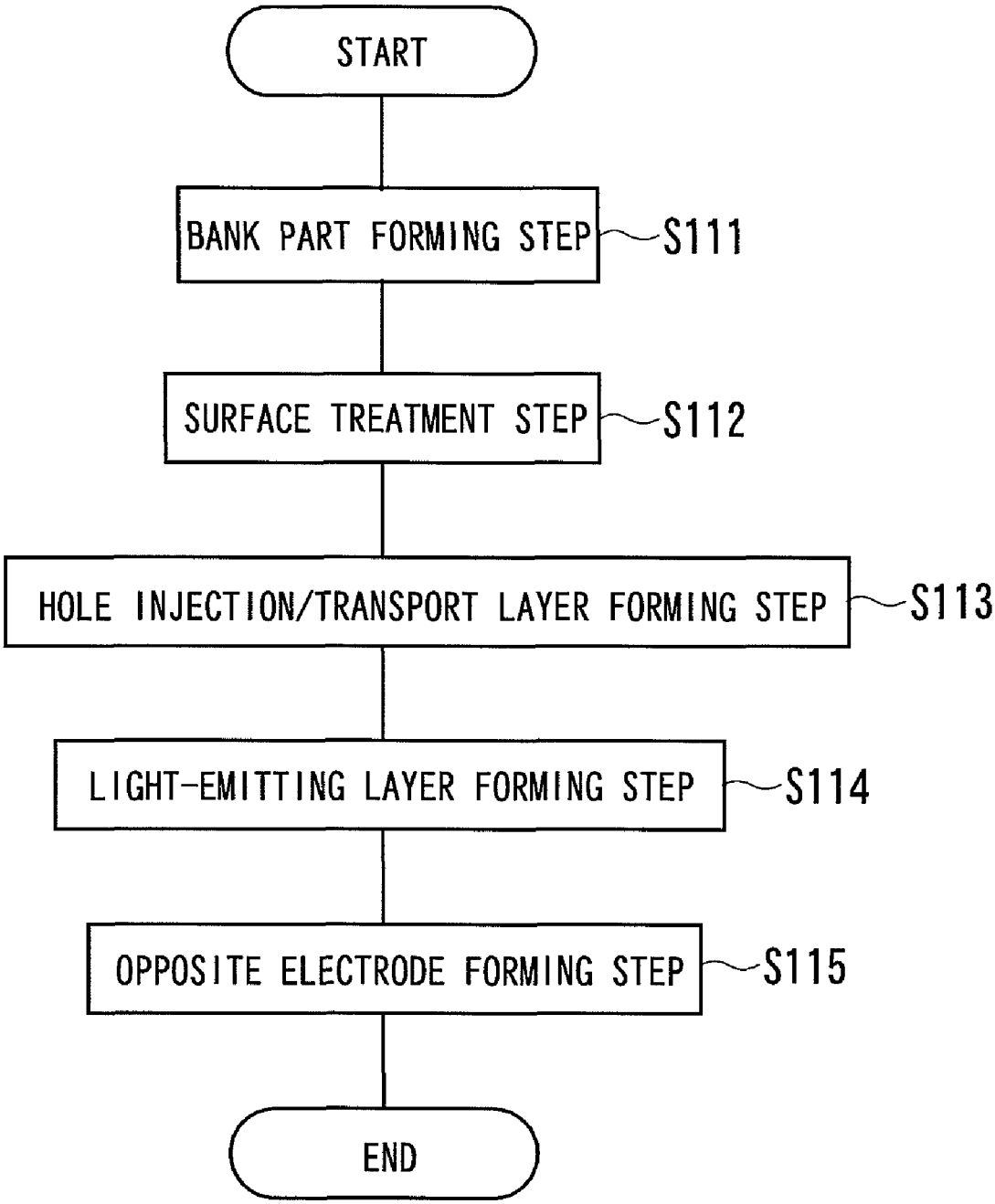
FIG. 16 is a flowchart illustrating manufacturing steps of the display as the organic EL apparatus.

As shown in FIG. 16, the display apparatus 600 is manufactured through a bank portion forming step (S111), a surface processing step (S112), a positive-hole injection/transport layer forming step (S113), a light-emitting layer forming step (S114), and a counter electrode forming step (S115). Note that the manufacturing steps are not limited to these examples shown in FIG. 16, and one of these steps may be omitted or another step may be added according as desired.

Figure 17:
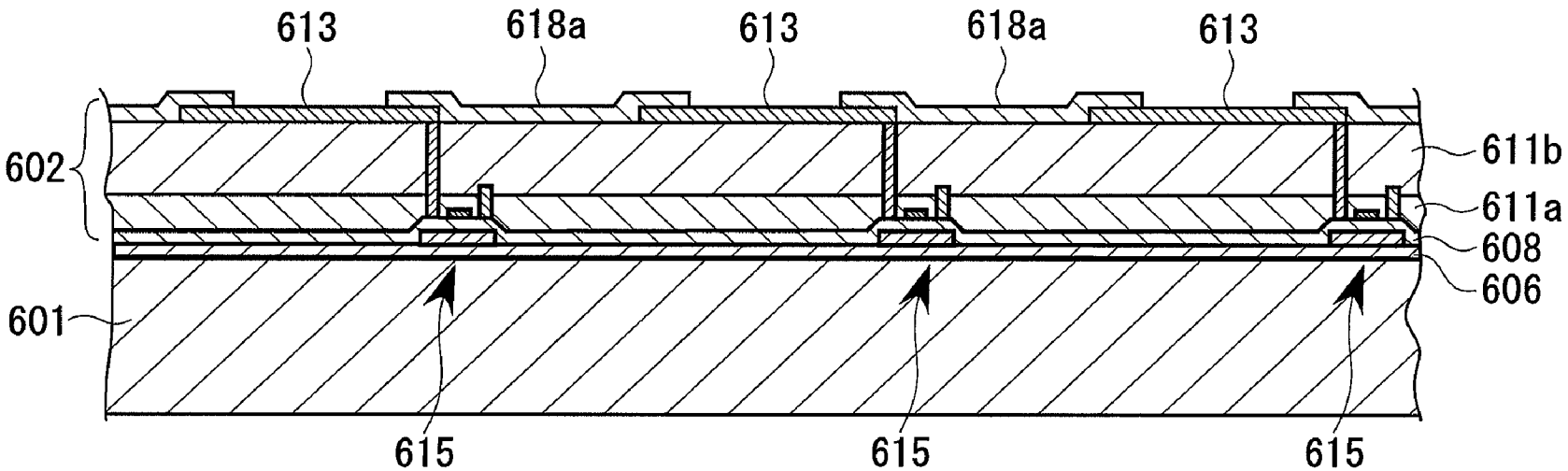
FIG. 17 is a process chart illustrating formation of an inorganic bank layer.

In the bank portion forming step (S111), as shown in FIG. 17, the inorganic bank layers 618*a* are formed on the second interlayer insulating film 611*b*. The inorganic bank layers 618*a* are formed by forming an inorganic film at a desired position and by patterning the inorganic film by the photolithography technique. At this time, a part of each of the inorganic bank layers 618*a* overlaps peripheries of corresponding two of the pixel electrodes 613 which sandwich each of the inorganic bank layers 618*a*.

Figure 18:
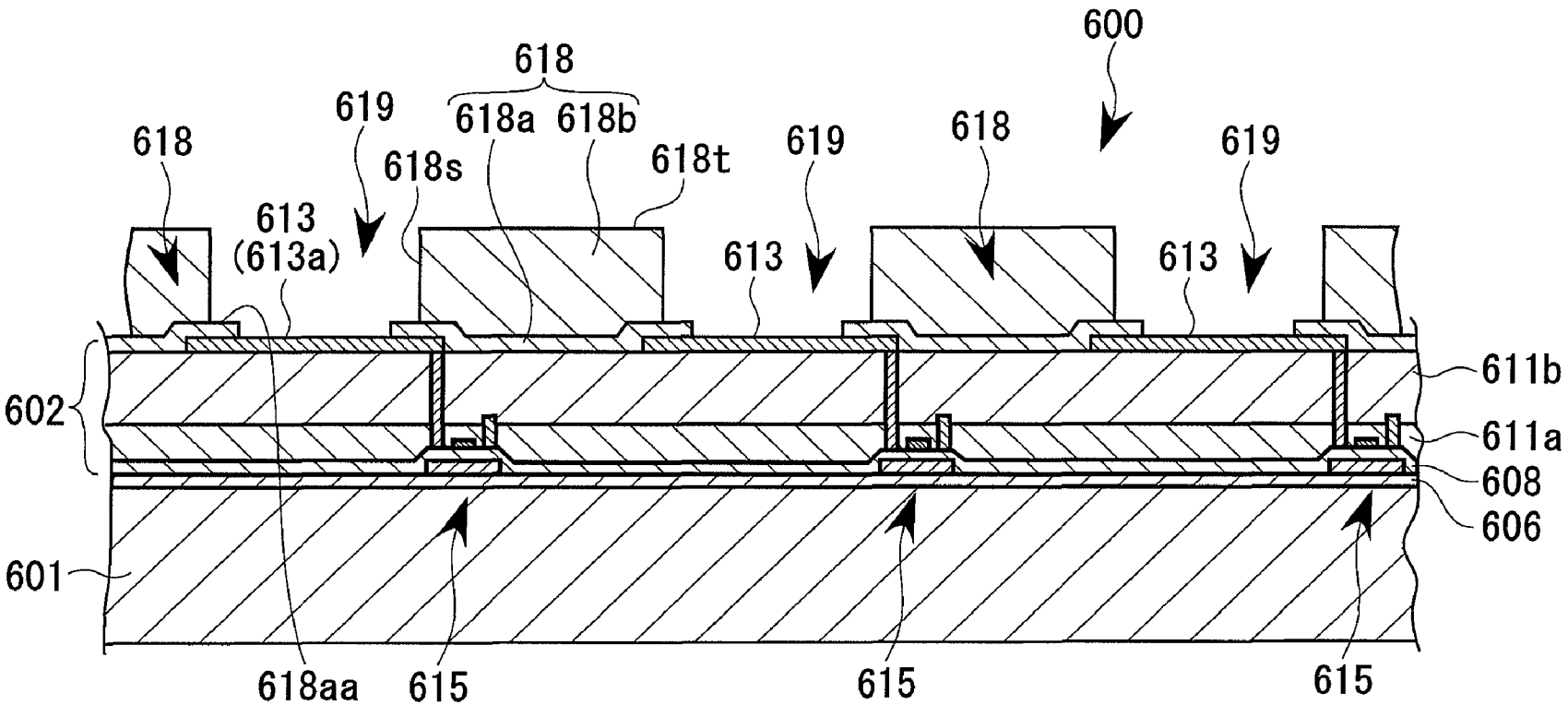
FIG. 18 is a process chart illustrating formation of an organic bank layer.

After the inorganic bank layers 618*a* are formed, as shown in FIG. 18, the organic bank layers 618*b* are formed on the inorganic bank layers 618*a*. As with the inorganic bank layers 618*a*, the organic bank layers 618*b* are formed by patterning a formed organic film by the photolithography technique.

The bank portions 618 are thus formed. When the bank portions 618 are formed, the openings 619 opening upward relative to the pixel electrodes 613 are formed between the bank portions 618. The openings 619 define pixel areas.

In the surface processing step (S112), a hydrophilic treatment and a repellency treatment are performed. The hydrophilic treatment is performed on first lamination areas 618*aa* of the inorganic bank layers 618*a* and electrode surfaces 613*a* of the pixel electrodes 613. The hydrophilic treatment is performed, for example, by plasma processing using oxide as a processing gas on surfaces of the first lamination areas 618*aa* and the electrode surfaces 613*a* to have hydrophilic properties. By performing the plasma processing, the ITO forming the pixel electrodes 613 is cleaned.

The repellency treatment is performed on walls 618*s* of the organic bank layers 618*b* and upper surfaces 618*t* of the organic bank layers 618*b*. The repellency treatment is performed as a fluorination treatment, for example, by plasma processing using tetrafluoromethane as a processing gas on the walls 618*s* and the upper surfaces 618*t*.

By performing this surface processing step, when the functional layers 617 is formed using the functional liquid droplet ejection heads 17, the functional liquid droplets are ejected onto the pixel areas with high accuracy. Furthermore, the functional liquid droplets attached onto the pixel areas are prevented from flowing out of the openings 619.

A display apparatus body 600A is obtained through these steps. The display apparatus body 600A is mounted on the set table 21 of the liquid droplet ejection apparatus 1 shown in FIG. 1 and the positive-hole injection/transport layer forming step (S113) and the light-emitting layer forming step (S114) are performed thereon.

Figure 19:
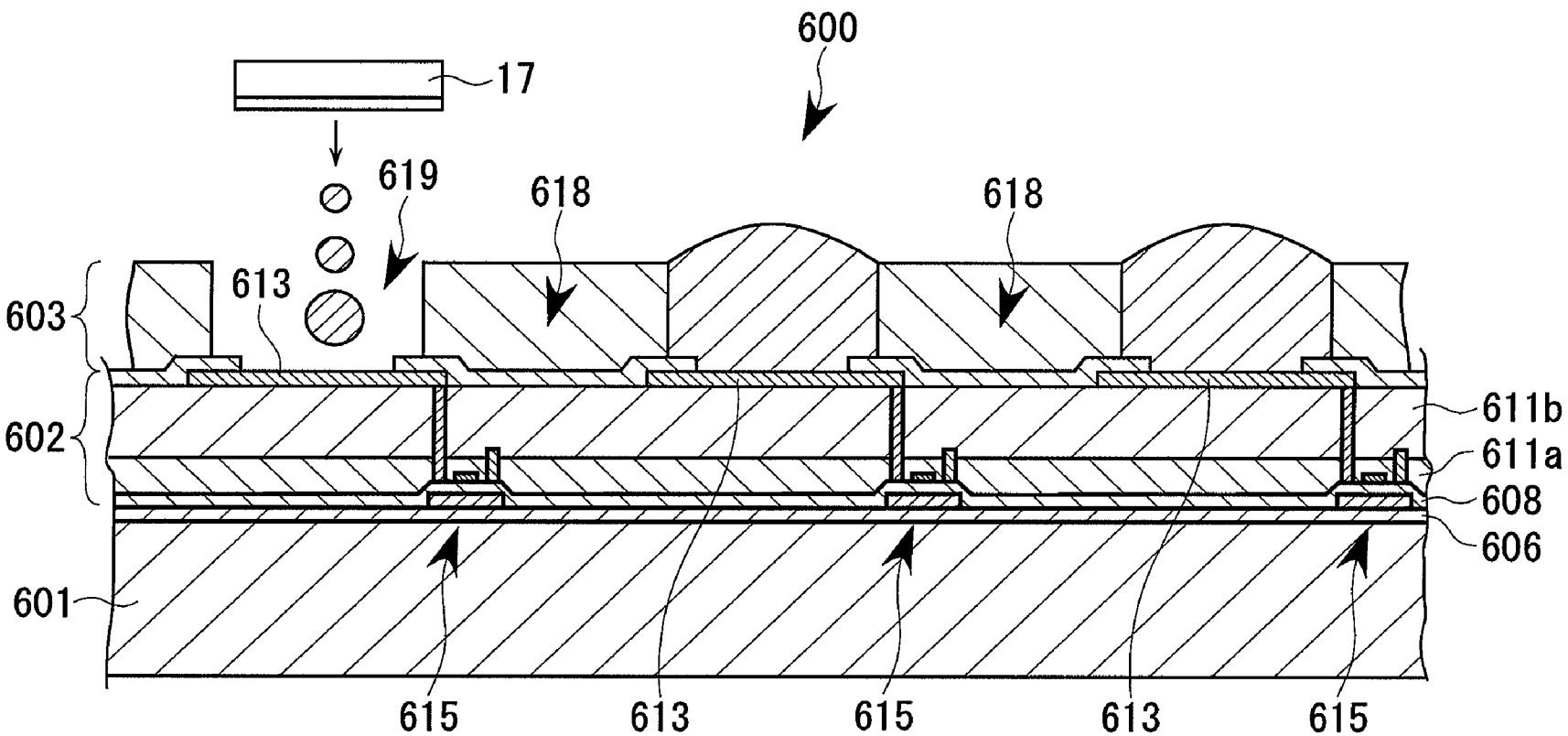
FIG. 19 is a process chart illustrating processes of forming a positive-hole injection/transport layer.
Figure 20:
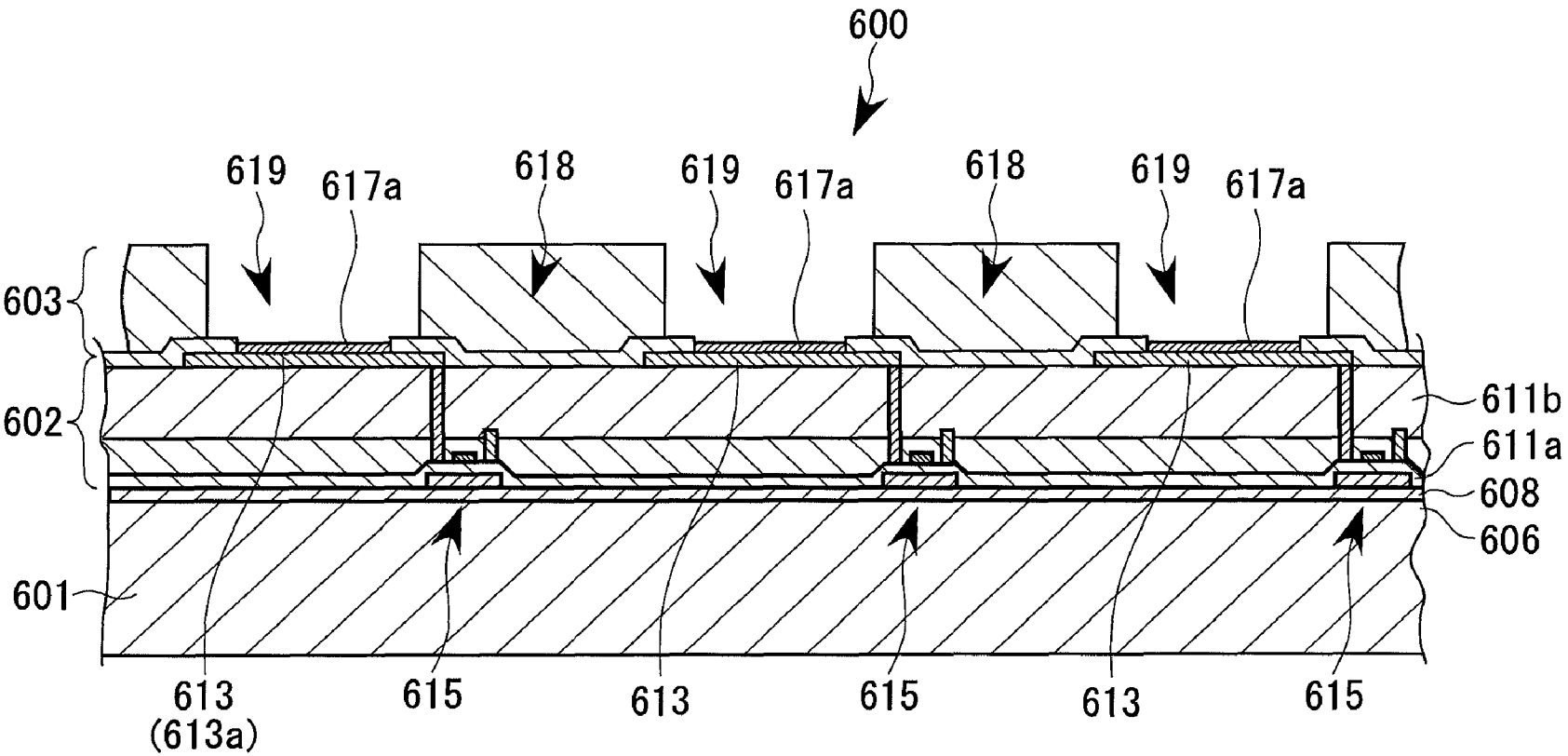
FIG. 20 is a process chart illustrating a state where the positive-hole injection/transport layer has been formed.

As shown in FIG. 19, in the positive-hole injection/transport layer forming step (S113), the first compositions including the material for forming a positive-hole injection/transport layer are ejected from the functional liquid droplet ejection heads 17 into the openings 619 included in the pixel areas. Thereafter, as shown in FIG. 20, drying processing and a thermal treatment are performed to evaporate polar solution included in the first composition whereby the positive-hole injection/transport layers 617*a* are formed on the pixel electrodes 613 (electrode surface 613*a*).

The light-emitting layer forming step (S114) will now be described. In the light-emitting layer forming step, as described above, a nonpolar solvent which is insoluble to the positive-hole injection/transport layers 617*a* is used as the solvent of the second composition used at the time of forming the light-emitting layer in order to prevent the positive-hole injection/transport layers 617*a* from being dissolved again.

On the other hand, since each of the positive-hole injection/transport layers 617*a* has low affinity to a nonpolar solvent, even when the second composition including the nonpolar solvent is ejected onto the positive-hole injection/transport layers 617*a*, the positive-hole injection/transport layers 617*a* may not be brought into tight contact with the light-emitting layers 617*b* or the light-emitting layers 617*b* may not be uniformly applied.

Accordingly, before the light-emitting layers 617*b* are formed, surface processing (surface improvement processing) is preferably performed so that each of the positive-hole injection/transport layers 617*a* has high affinity to the nonpolar solvent and to the material for forming the light-emitting layers. The surface processing is performed by applying a solvent the same as or similar to the nonpolar solvent of the second composition used at the time of forming the light-emitting layers on the positive-hole injection/transport layers 617*a* and by drying the applied solvent.

Employment of this surface processing allows the surface of the positive-hole injection/transport layers 617*a* to have high affinity to the nonpolar solvent, and therefore, the second composition including the material for forming the light-emitting layers can be uniformly applied to the positive-hole injection/transport layers 617*a* in the subsequent step.

Figure 21:
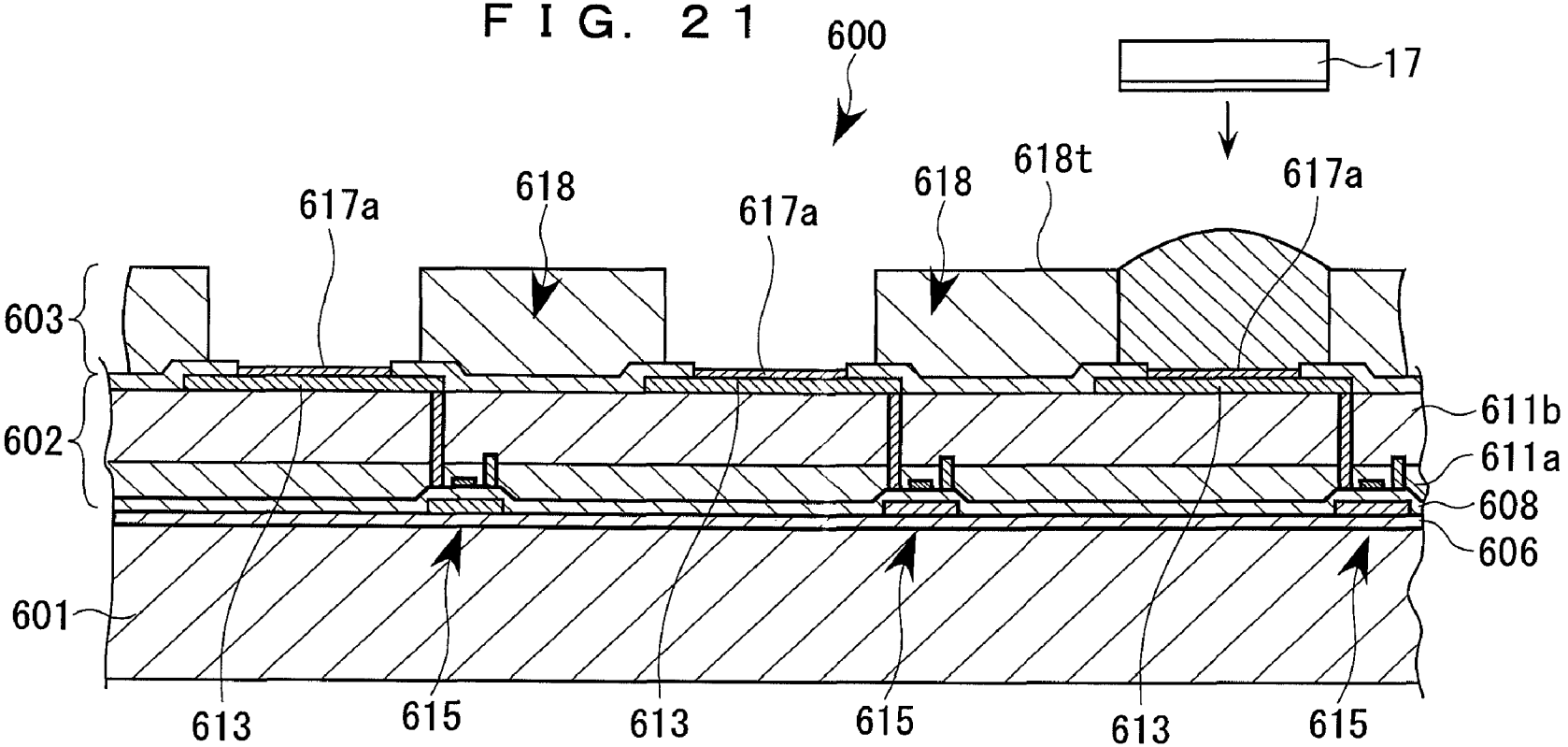
FIG. 21 is a process chart illustrating processes for forming a light-emitting layer having a blue color component.

As shown in FIG. 21, a predetermined amount of second composition including the material for forming the light-emission layers of one of the three colors (blue color (B) in an example of FIG. 21) is ejected into the pixel areas (openings 619) as functional liquid. The second composition ejected into the pixel areas spreads over the positive-hole injection/transport layer 617*a* and fills the openings 619. Note that, even if the second composition is ejected and attached to the upper surfaces 618*t* of the bank portions 618 which are outside of the pixel area, since the repellency treatment has been performed on the upper surfaces 618*t* as described above, the second component easily drops into the openings 619.

Figure 22:
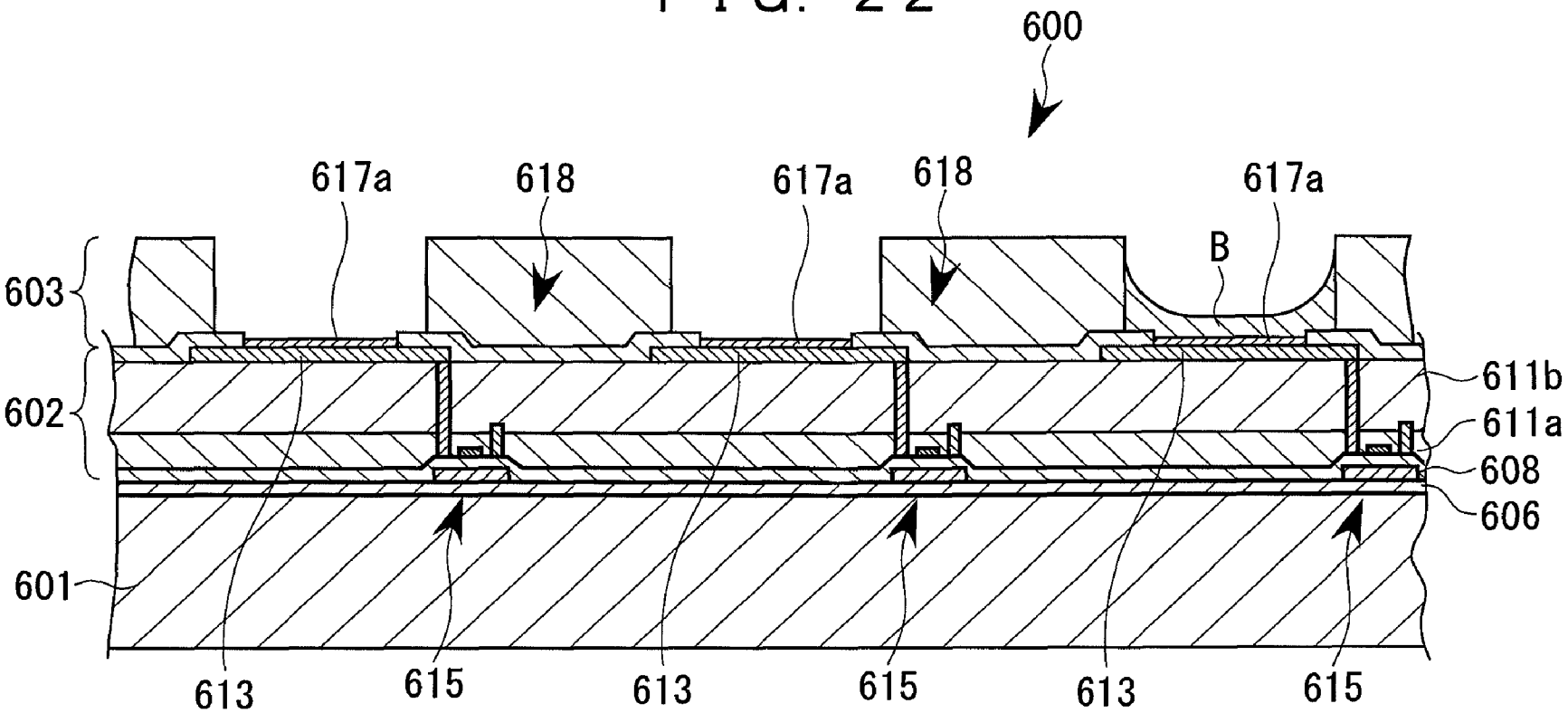
FIG. 22 is a process chart illustrating a state where the light-emitting layer having a blue color component has been formed.

Thereafter, the drying processing is performed so that the ejected second composition is dried and the nonpolar solvent included in the second composition is evaporated whereby the light-emitting layers 617*b* are formed on the positive-hole injection/transport layers 617*a* as shown in FIG. 22. In FIG. 22, one of the light-emitting layers 617*b* corresponding to the blue color (B) is formed.

Figure 23:
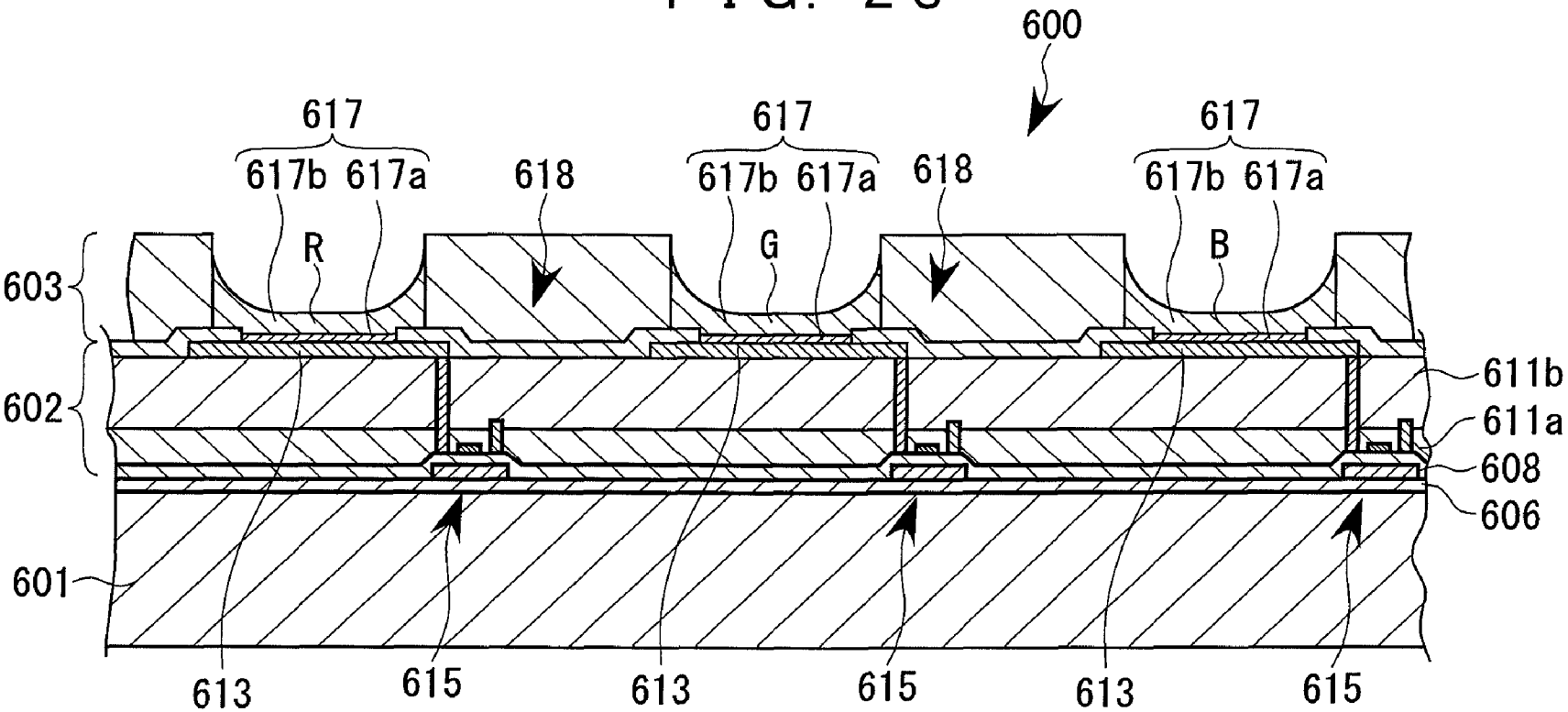
FIG. 23 is a process chart illustrating a state where light-emitting layers having three color components have been formed.

Similarly, as shown in FIG. 23, a step similar to the above-described step of forming the light-emitting layers 617*b* corresponding to the blue color (B) is repeatedly performed by using functional liquid droplet ejection heads 17 so that the light-emitting layers 617*b* corresponding to other colors (red (R) and green (G)) are formed. Note that the order of formation of the light-emitting layers 617*b* is not limited to the order described above as an example, and any other orders may be applicable. For example, an order of forming the light-emitting layers 617*b* may be determined in accordance with a light-emitting layer forming material. Furthermore, the color scheme pattern of the three colors R, G, and B may be the stripe arrangement, the mosaic arrangement, or the delta arrangement.

As described above, the functional layers 617, that is, the positive-hole injection/transport layers 617*a* and the light-emitting layers 617*b* are formed on the pixel electrodes 613. Then, the process proceeds to the counter electrode forming step (S115).

Figure 24:
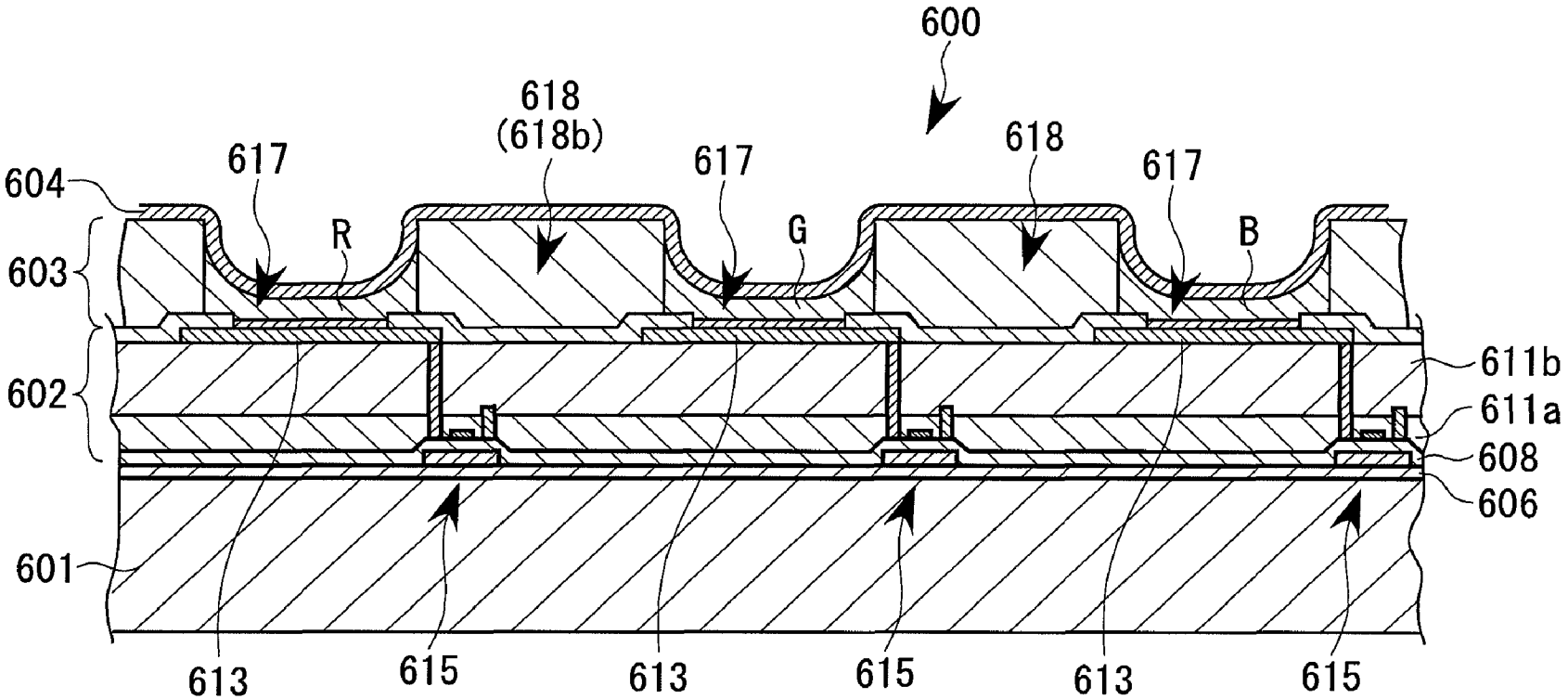
FIG. 24 is a process chart illustrating processes for forming a cathode.

In the counter electrode forming step (S115), as shown in FIG. 24, the cathode (counter electrode) 604 is formed on entire surfaces of the light-emitting layers 617*b* and the organic bank layers 618*b* by an evaporation method, sputtering, or a CVD (chemical vapor deposition) method, for example. The cathode 604 is formed by laminating a calcium layer and an aluminum layer, for example, in this embodiment.

An Al film and a Ag film as electrodes and a protective layer formed of $SiO_2$ or SiN for preventing the Al film and the Ag film from being oxidized are formed on the cathode 604.

After the cathode 604 is thus formed, other processes such as sealing processing of sealing a top surface of the cathode 604 with a sealing member and wiring processing are performed whereby the display apparatus 600 is obtained.

Figure 25:
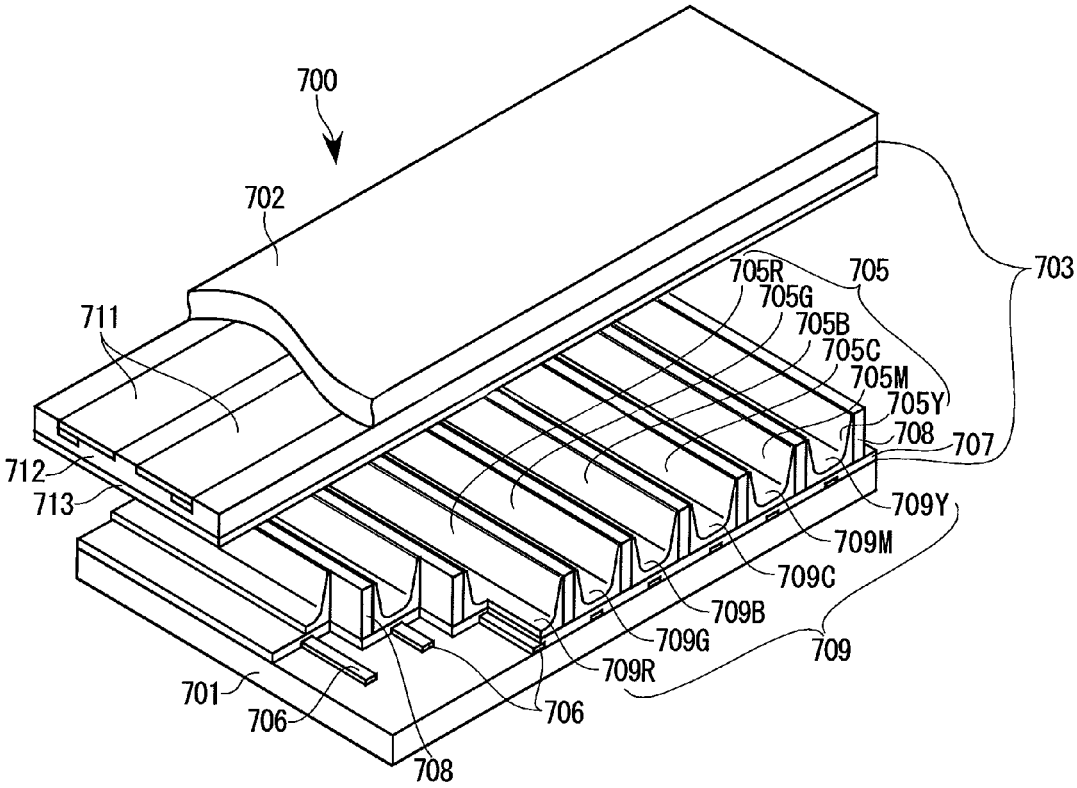
FIG. 25 is a perspective view illustrating an essential part of a plasma display apparatus (PDP apparatus).

FIG. 25 is an exploded perspective view of an essential part of a plasma display apparatus (PDP apparatus: hereinafter simply referred to as a display apparatus 700). Note that, in FIG. 25, the display apparatus 700 is partly cut away.

The display apparatus 700 includes a first substrate 701, a second substrate 702 which faces the first substrate 701, and a discharge display portion 703 interposed therebetween. The discharge display portion 703 includes a plurality of discharge chambers 705. The discharge chambers 705 include red discharge chambers 705R, green discharge chambers 705G, and blue discharge chambers 705B, and are arranged so that one of the red discharge chambers 705R, one of the green discharge chambers 705G, and one of the blue discharge chambers 705B constitute one pixel as a group.

Address electrodes 706 are arranged on the first substrate 701 with predetermined intervals therebetween in a stripe pattern, and a dielectric layer 707 is formed so as to cover top surfaces of the address electrodes 706 and the first substrate 701. Partition walls 708 are arranged on the dielectric layer 707 so as to be arranged along with the address electrodes 706 in a standing manner between the adjacent address electrodes 706. Some of the partition walls 708 extend in a width direction of the address electrodes 706 as shown in FIG. 25, and the others (not shown) extend perpendicular to the address electrodes 706.

Regions partitioned by the partition walls 708 serve as the discharge chambers 705.

The discharge chambers 705 include respective fluorescent substances 709. Each of the fluorescent substances 709 emits light having one of the colors of red (R), green (G) and blue (B). The red discharge chamber 705R has a red fluorescent substance 709R on its bottom surface, the green discharge chamber 705G has a green fluorescent substance 709G on its bottom surface, and the blue discharge chamber 705B has a blue fluorescent substance 709B on its bottom surface.

On a lower surface of the second substrate 72 in FIG. 25, a plurality of display electrodes 711 are formed with predetermined intervals therebetween in a stripe manner in a direction perpendicular to the address electrodes 706. A dielectric layer 712 and a protective film 713 formed of MgO, for example, are formed so as to cover the display electrodes 711.

The first substrate 701 and the second substrate 702 are attached so that the address electrodes 706 are arranged perpendicular to the display electrodes 711. Note that the address electrodes 706 and the display electrodes 711 are connected to an alternate power source (not shown).

When the address electrodes 706 and the display electrodes 711 are brought into conduction states, the fluorescent substances 709 are excited and emit light whereby display with colors is achieved.

In this embodiment, the address electrodes 706, the display electrodes 711, and the fluorescent substances 709 may be formed using the liquid droplet ejection apparatus 1 shown in FIG. 1. Steps of forming the address electrodes 706 on the first substrate 701 are described hereinafter.

The steps are performed in a state where the first substrate 701 is mounted on the set table 21 on the liquid droplet ejection apparatus 1.

The functional liquid droplet ejection heads 17 eject a liquid material (functional liquid) including a material for forming a conducting film wiring as functional droplets to be attached onto regions for forming the address electrodes 706. The material for forming a conducting film wiring included in the liquid material is formed by dispersing conductive fine particles such as those of a metal into dispersed media. Examples of the conductive fine particles include a metal fine particle including gold, silver, copper, palladium, or nickel, and a conductive polymer.

When ejection of the liquid material onto all the desired regions for forming the address electrodes 706 is completed, the ejected liquid material is dried, and the disperse media included in the liquid material is evaporated whereby the address electrodes 706 are formed.

Although the steps of forming the address electrodes 706 are described as an example above, the display electrodes 711 and the fluorescent substances 709 may be formed by the steps described above.

In a case where the display electrodes 711 are formed, as with the address electrodes 706, a liquid material (functional liquid) including a material for forming a conducting film wiring is ejected from the functional liquid droplet ejection heads 17 as liquid droplets to be attached to the areas for forming the display electrodes.

In a case where the fluorescent substances 709 are formed, a liquid material including fluorescent materials corresponding to three colors (R, G, and B) is ejected as liquid droplets from the functional liquid droplet ejection heads 17 so that liquid droplets having the three colors (R, G, and B) are attached within the discharge chambers 705.

Figure 26:
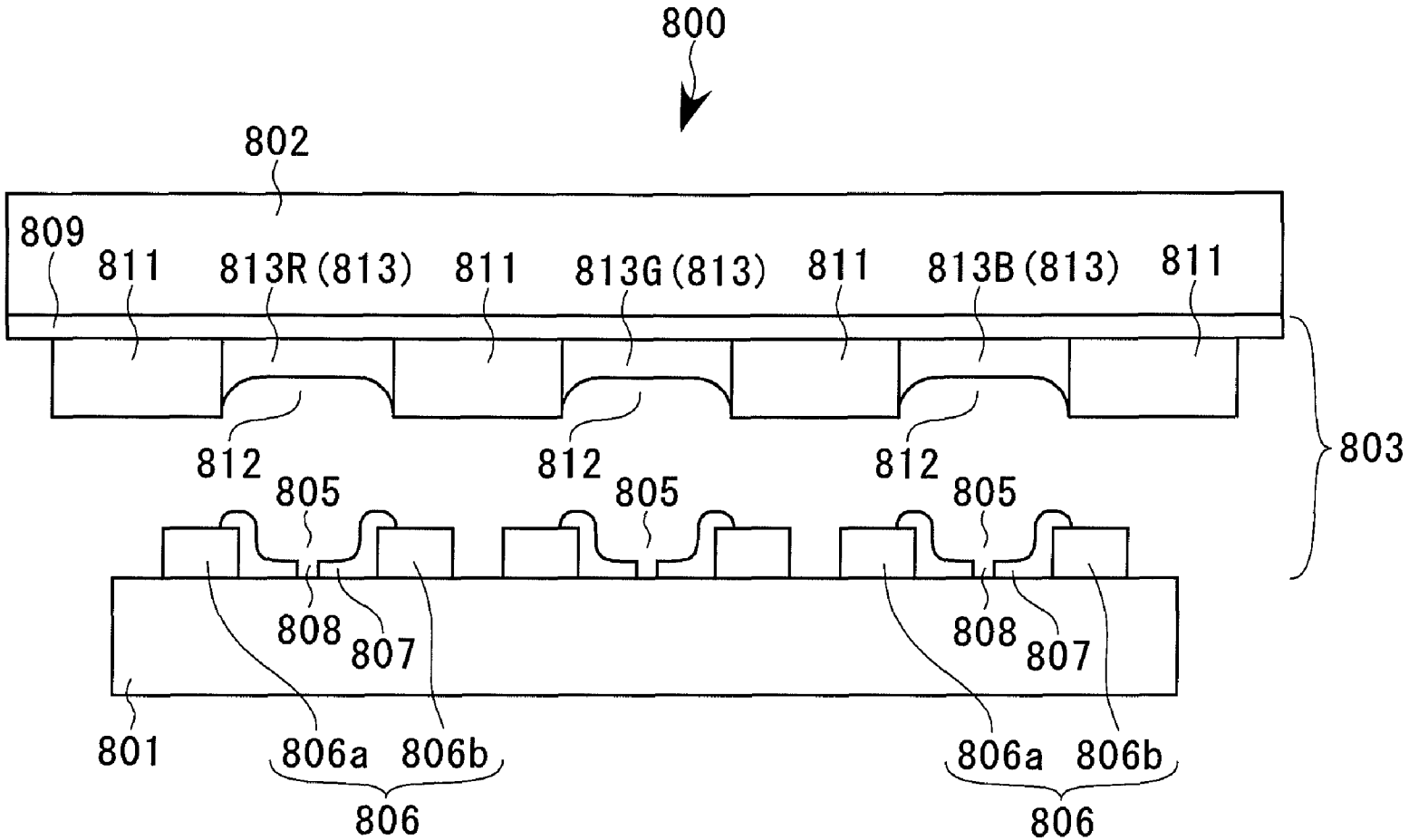
FIG. 26 is a sectional view illustrating an essential part of an electron emission display apparatus (FED apparatus).

FIG. 26 shows a sectional view of an essential part of an electron emission apparatus (also referred to as a FED apparatus or a SED apparatus: hereinafter simply referred to as a display apparatus 800). In FIG. 26, a part of the display apparatus 800 is shown in the sectional view.

The display apparatus 800 includes a first substrate 801, a second substrate 802 which faces the first substrate 801, and a field-emission display portion 803 interposed therebetween. The field-emission display portion 803 includes a plurality of electron emission portions 805 arranged in a matrix.

First element electrodes 806*a* and second element electrodes 806*b*, and conductive films 807 are arranged on the first substrate 801. The first element electrodes 806*a* and the second element electrodes 806*b* intersect with each other. Cathode electrodes 806 are formed on the first substrate 801, and each of the cathode electrodes 806 is constituted by one of the first element electrodes 806*a* and one of the second element electrodes 806*b*. In each of the cathode electrodes 806, one of the conductive films 807 having a gap 808 is formed in a portion formed by the first element electrode 806*a* and the second element electrode 806*b*. That is, the first element electrodes 806*a*, the second element electrodes 806*b*, and the conductive films 807 constitute the plurality of electron emission portions 805. Each of the conductive films 807 is constituted by palladium oxide (PdO). In each of the cathode electrodes 806, the gap 808 is formed by forming processing after the corresponding one of the conductive films 807 is formed.

An anode electrode 809 is formed on a lower surface of the second substrate 802 so as to face the cathode electrodes 806. A bank portion 811 is formed on a lower surface of the anode electrode 809 in a lattice. Fluorescent materials 813 are arranged in opening portions 812 which opens downward and which are surrounded by the bank portion 811. The fluorescent materials 813 correspond to the electron emission portions 805. Each of the fluorescent materials 813 emits fluorescent light having one of the three colors, red (R), green (G), and blue (B). Red fluorescent materials 813R, green fluorescent materials 813G, and blue fluorescent materials 813B are arranged in the opening portions 812 in a predetermined arrangement pattern described above.

The first substrate 801 and the second substrate 802 thus configured are attached with each other with a small gap therebetween. In this display apparatus 800, electrons emitted from the first element electrodes 806*a* or the second element electrodes 806*b* included in the cathode electrodes 806 hit the fluorescent materials 813 formed on the anode electrode 809 so that the fluorescent materials 813 are excited and emit light whereby display with colors is achieved.

As with the other embodiments, in this case also, the first element electrodes 806*a*, the second element electrodes 806*b*, the conductive films 807, and the anode electrode 809 may be formed using the liquid droplet ejection apparatus 1. In addition, the red fluorescent materials 813R, the green fluorescent materials 813G, and the blue fluorescent materials 813B may be formed using the liquid droplet ejection apparatus 1.

Figure 27A:
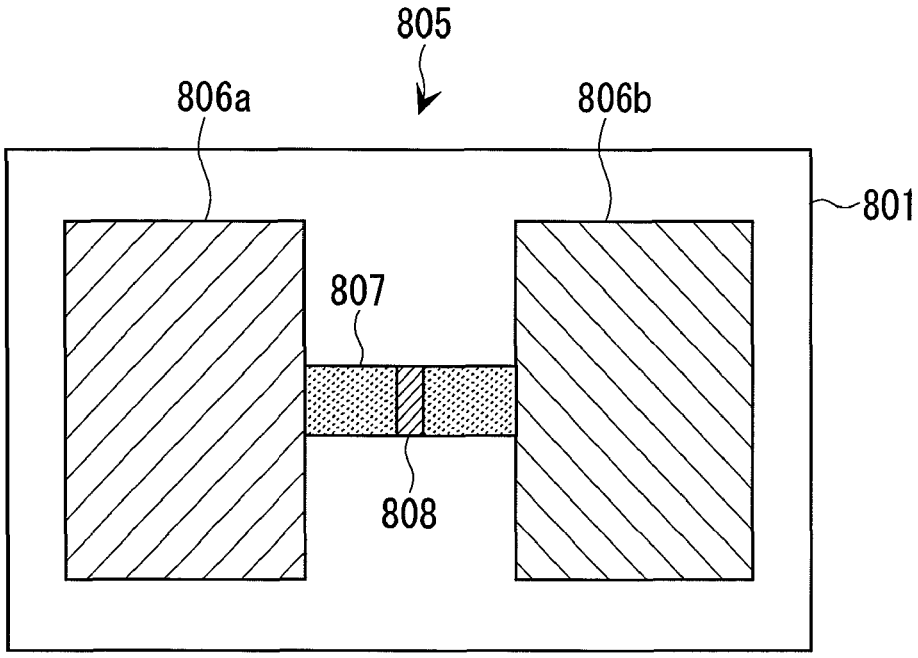
FIG. 27A is a plan view illustrating an electron emission portion and the vicinity thereof of a display apparatus.
Figure 27B:
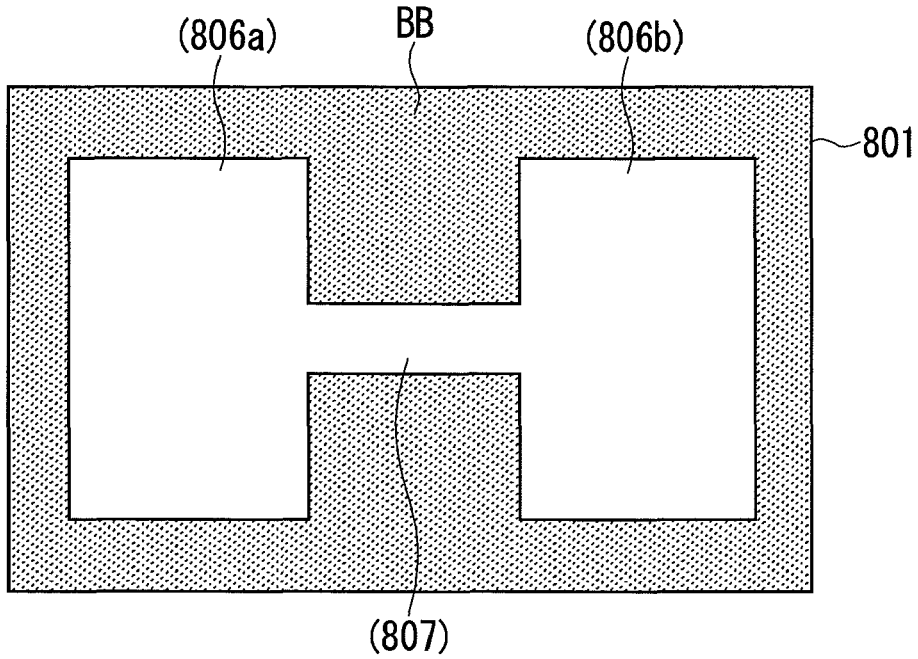
FIG. 27B is a plan view illustrating a method of forming the electron emission portion and the vicinity thereof.

Each of the first element electrodes 806*a*, each of the second element electrodes 806*b*, and each of the conductive films 807 have shapes as shown in FIG. 27A. When the first element electrodes 806*a*, the second element electrodes 806*b*, and the conductive films 807 are formed, portions for forming the first element electrodes 806*a*, the second element electrodes 806*b*, and the conductive films 807 are left as they are on the first substrate 801 and only bank portions BB are formed (by a photolithography method) as shown in FIG. 27B. Then, the first element electrodes 806*a* and the second element electrodes 806*b* are formed by an inkjet method using a solvent ejected from the liquid droplet ejection apparatus 1 in grooves defined by the bank portions BB and are formed by drying the solvent. Thereafter, the conductive films 807 are formed by the inkjet method using the liquid droplet ejection apparatus 1. After forming the conductive films 807, the bank portions BB are removed by ashing processing and the forming processing is performed. Note that, as with the case of the organic EL device, the hydrophilic treatment is preferably performed on the first substrate 801 and the second substrate 802 and the repellency treatment is preferably performed on the bank portion 811 and the bank portions BB.

Examples of other electro-optical apparatuses include an apparatus for forming metal wiring, an apparatus for forming a lens, an apparatus for forming a resist, and an apparatus for forming an optical diffusion body. Use of the liquid droplet ejection apparatus 1 makes it possible to efficiently manufacture various electro-optical apparatuses.

What is claimed is:

1. A suction device having a plurality of head caps capable of closely contacting with and moving away from corresponding nozzle surfaces of a plurality of inkjet functional liquid droplet ejection heads, the suction device comprising:

a plurality of cap units on which one or more of the head caps are mounted;

a contacting/separating mechanism that makes the respective head caps contact with and move away in units of the cap units;

a plurality of suction units each of which is connected to the plurality of cap units and sucks functional liquid from the head caps in units of the cap units with different levels of suction pressure from each other;

a plurality of sets of suction channels each of which includes a main channel connecting an upstream side thereof to the associated cap units and a plurality of individual channels branched from the main channel through a branch and connecting downstream sides thereof to the associated suction units; and a plurality of channel switching units that is disposed at the respective branches of the suction channels and selectively switches the suction channels to any one of the suction units.

2. The suction device according to claim 1, wherein the suction units each have a waste liquid tank connected to a downstream end of the individual channels, and an ejector having a primary side with compressed air introduced thereto and a secondary side connected to an upper space of the waste liquid tank.

3. The suction device according to claim 2, wherein the suction units each has a pressure adjustment unit that adjusts pressure of the compressed air at the primary side, and a control unit that controls the pressure adjustment unit.

4. The suction device according to claim 3, wherein each of the individual channels connected to the respective suction units is provided with a channel opening/closing unit that opens and closes the individual channels, and each of the control units controls the pressure adjustment unit depending on a number of opening of the channel opening/closing unit that is open out of the plurality of channel opening/closing units such that a suction pressure is constant in the cap units.

5. The suction device according to claim 4, further comprising a pressure detection unit that detects pressure in each of the waste liquid tanks during suction, wherein the control units control the pressure adjustment unit such that the pressure in the waste liquid tank is set to be a predetermined pressure according to the number of opening of the channel opening/closing unit.

6. The suction device according to claim 4, further comprising a flow rate detection unit that detects a flow rate of functional liquid flowing into each of the waste liquid tanks by suction, wherein the control unit controls the pressure adjustment unit such that the flow rate of the functional liquid flowing into the waste liquid tank is set to be a predetermined flow rate according to the number of opening of the channel opening/closing unit.

7. The suction device according to claim 1, wherein the plurality of suction units is composed of two suction units, one of the suction units sucking functional liquid with the head caps closely contacted with the functional liquid droplet ejection heads and the other of the suction unit sucking functional liquid with the head caps spaced away from the functional liquid droplet ejection heads.

8. The suction device according to claim 1, wherein the individual channels are combined by a manifold and connected to the suction units via junction channels, and the manifold is formed like a funnel of which upper end is blocked by a discoidal cover and downstream sides of the plurality of individual channels are so connected to the cover as to be evenly arranged in a circumferential direction of the manifold.

9. A suction system comprising:

the plurality of functional liquid droplet ejection heads arranged in a plurality of sets of colors of functional liquid; and a plurality of sets of the suction devices set forth in claim 1 by the colors of the functional liquid.

10. The suction system according to claim 9, wherein the plurality of sets of suction devices are composed of six sets of suction devices corresponding to six colors of the functional liquid.

11. The suction system according to claim 9, wherein a plurality of sets of one or more of the head caps by color are mounted on a carriage unit.

12. A liquid droplet ejection apparatus comprising:

a plotting unit that performs plotting on a workpiece by ejecting functional liquid droplets from a plurality of inkjet functional liquid droplet ejection heads while moving the functional liquid droplet ejection heads, and the suction system set forth in claim 9.

13. A liquid droplet ejection apparatus comprising:

a plotting unit that performs plotting on a workpiece by ejecting functional liquid droplets from a plurality of inkjet functional liquid droplet ejection heads while moving the functional liquid droplet ejection heads, and the suction device set forth in claim 1.

14. An electro-optical apparatus comprising:

a film portion formed on a workpiece with functional liquid droplets by using the liquid droplet ejection apparatus set forth in claim 13.

* * * * *